US007058327B2

(12) United States Patent
Isobe

(10) Patent No.: US 7,058,327 B2
(45) Date of Patent: Jun. 6, 2006

(54) TRANSFER APPARATUS, IMAGE FORMING APPARATUS, AND METHOD OF BELT-SPEED CORRECTION

(75) Inventor: Takundo Isobe, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 79 days.

(21) Appl. No.: 10/743,730

(22) Filed: Dec. 24, 2003

(65) Prior Publication Data

US 2004/0184831 A1 Sep. 23, 2004

(30) Foreign Application Priority Data

Dec. 27, 2002 (JP) ..... 2002-382316
Dec. 19, 2003 (JP) ..... 2003-423765

(51) Int. Cl.
*G03G 15/16* (2006.01)

(52) U.S. Cl. ..... 399/66; 399/397; 399/302

(58) Field of Classification Search ..... 399/66, 399/162, 297, 302, 303, 312
See application file for complete search history.

(56) References Cited

U.S. PATENT DOCUMENTS 5,146,240 A 9/1992 Hayashi et al.
5,867,759 A 2/1999 Isobe et al.
6,049,690 A * 4/2000 Nakayasu et al. ..... 399/301
6,195,519 B1 2/2001 Isobe et al.

FOREIGN PATENT DOCUMENTS

JP 11-24507 1/1999
JP 2000356936 A * 12/2000

OTHER PUBLICATIONS

Oki Technical Review, Table 1, 1998, http://www.oki.com/en/otr/html/nf/otr-161-05-tab-1.html.*

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A belt rotates and carries a plurality of images. A scale is provided along at least one side of entire of the belt. A sensor reads the scale on the belt to obtain scale information. An actual speed calculating unit calculates a speed of the belt from the scale information. A control unit provides a control to correct speed of the belt according to the speed calculated. The control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed.

39 Claims, 13 Drawing Sheets

TRANSFER APPARATUS, IMAGE FORMING APPARATUS, AND METHOD OF BELT-SPEED CORRECTION

CROSS-REFERENCE TO RELATED APPLICATIONS

The present document incorporates by reference the entire contents of Japanese priority document, 2002-382316 filed in Japan on Dec. 27, 2002 and 2003-423765 filed in Japan on Dec. 19, 2003.

BACKGROUND OF THE INVENTION

1) Field of the Invention

The present invention relates to a transfer apparatus, an image forming apparatus, and a method of belt-speed correction, in which an actual speed of a belt is detected by reading a scale that is provided along the whole circumference of the running belt, by a sensor, and performing a correction control by applying correction to a belt speed that is detected by the sensor to match the belt speed with a target speed.

2) Description of the Related Art

In recent years, a majority of image forming apparatus in which electrophotography is employed, like copying machines and printers, are capable of forming a full-color image as per the requirement of the market.

Some color image forming apparatuses, called one-drum (single drum) image forming apparatuses, include a plurality of developing units around one photosensitive drum, that develop images with toners of different colors. The developing units apply toners on a latent image on the photosensitive drum to form a super-imposed full color toner image. The toner image is transferred to a sheet that is a recording material to obtain a color image.

Among the color image forming apparatuses, there are apparatuses, called tandem image-forming apparatuses, in which a plurality of photosensitive drums are arranged in a row and a developing unit is provided for each of the photosensitive drum, where each developing unit develops different color. A single color toner image is formed on each of the photosensitive drums and these single color toner images are transferred one after another to a belt or a sheet. Thus, a full color toner image is formed on the belt or the sheet.

The one drum image forming apparatuses are smaller because there is only one drum. The smaller size also implies reduced cost which is another advantage. However, in the one drum image forming apparatus, the photosensitive drum is rotated several time (four time for a full-color image) to form one full-color image which leads to difficulties in accelerating the speed of image formation. This is a drawback of the one drum image forming apparatus.

Whereas, in the case of the tandem image-forming apparatus, due to the requirement of plurality of photosensitive drums, the image forming apparatus tend to be bigger, consequently resulting in increase in the cost. However, there is a scope for accelerating the speed of image forming in the tandem image-forming apparatus.

Lately, a color image is also sought to be formed with the speed same as that of the monochrome image formation and the tandem image-forming apparatus has been drawing attention for this reason.

As shown in FIG. 17, the tandem image-forming apparatus includes photosensitive drums 91Y, 91M, 91C, and 91K that are arranged in a straight line. Toner images on the photosensitive drums 91Y, 91M, 91C, and 91K are transferred one after another to a sheet P that is carried on a sheet carrier belt 93 which is running in a direction of an arrow A, by transferring units 92 for each photosensitive drum. Thus, a full-color image is formed on the sheet P by a direct transfer. As shown in FIG. 18, toner images on a plurality of photosensitive drums 91Y, 91M, 91C, and 91K are transferred one after another to an intermediate transfer belt 94 that is running in a direction of an arrow B such that the images are superimposed. The superimposed image on the intermediate transfer belt 94 is transferred collectively to a sheet P by a secondary transferring unit 95. Thus, the superimposed image is formed on the sheet P by an indirect transfer.

If the direct transfer and the indirect transfer are compared to each other, in the former case, the plurality of photosensitive drums is arranged in a line. A paper feeding unit 96 is disposed on an upstream side of the drum arrangement and a fixing unit 97 is disposed on a downstream side of the drum arrangement. This structure results in increase in size along the direction of sheet transfer.

Whereas in a case of the indirect transfer, a secondary transferring position can be set voluntarily. Therefore, as shown in FIG. 18, the secondary transferring unit 95 is disposed on a downstream side of the intermediate transfer belt 94 and a paper feeding unit 96 can also be disposed on the downstream side of the intermediate transfer belt 94. Therefore, it is possible to reduce the size of the image forming apparatus along the width of the apparatus (a direction from left to right in FIG. 18).

In a direct-transfer tandem image-forming apparatus, if the size of the apparatus is reduced to a possible extent along the width of the apparatus, the fixing unit 97 has to be disposed close to the sheet carrier belt 93. If the fixing unit 97 is disposed, close to the sheet carrier belt 93, when a tip of the sheet P reaches a nip of the fixing unit 97, even if the sheet P tends to bend due to the difference in linear speeds of the sheet carrier belt 93 and the fixing unit 97 (linear speed of the fixing unit 97 is slower), since the distance from the sheet carrier belt 93 to the fixing unit is extremely short, particularly in a case of a thick sheet, the sheet vibrates due to striking when a tip of the sheet reaches the nip of the fixing roller 97. This may result in affecting the image.

To solve this problem, in the case of an indirect-transfer tandem image-forming apparatus, since the secondary transferring unit 95 can be disposed on the downstream side of the intermediate transfer belt 94, even if the size of the apparatus is reduced along the width of the apparatus, the fixing unit 97 can be disposed such that it is away from the intermediate transfer belt. As a result, even when the tip of the sheet reaches the nip of the fixing unit 97, the sheet bends so that it can overcome the difference in the linear speeds of the intermediate transfer belt 94 and the fixing roller 97. Thus, the difference in the linear speeds is overcome, thereby avoiding any effect on the image.

Due to these various advantages, the indirect-transfer tandem image-forming apparatus has been drawing attention nowadays.

However, in the tandem image-forming apparatus, where a plurality of photosensitive drums are arranged in a line to deal with toners of different colors, the color image is formed by superimposing the toner images of different colors that are formed on the photosensitive drums on a sheet or on an intermediate transfer belt. If the positions of superimposing of the toner images of different colors are shifted, there is a shift in colors or a minute change in shade which deteriorates the image quality. Therefore, position shift (color shift) of the toner image of each color has been an important issue.

One of the known causes of the color shift is an uneven speed of the intermediate transfer belt in the case of the indirect transfer (uneven speed of the sheet carrier belt in a case of the direct transfer).

According to a technology disclosed in Japanese Patent Application Laid-open Publication No. H11-24507, an arrangement to apply correction to the uneven speed of the intermediate belt is provided in a color image forming apparatus that uses a conventional transfer belt.

A color copying machine that is disclosed in Japanese Patent Application Laid-open Publication No. H24507, includes an intermediate belt (the transfer belt) that is stretched over five supporting rollers that include a driving roller. Toner images of four colors viz. cyan, magenta, yellow, and black are transferred on an outer circumferential surface of the intermediate transfer belt by superimposing the image for each color one after another. Thus, a full-color image is formed.

An inner surface of the intermediate transfer belt of the color copying machine is provided with a scale having minute and precise graduations. The scale is read by an optical detector to detect the speed of the intermediate transfer belt accurately. The detected speed is subjected to feed-back control by a feed-back control system to adjust the correct speed of the intermediate transfer belt.

The feed-back control system is equipped with a position controlling circuit (position controller), a speed controlling circuit (speed controller), a power converting circuit (power converter), a position detecting circuit (position detector), a speed detecting circuit (speed detector) etc. apart from the optical detector. The position controlling circuit calculates deviation of the accurate and minute position signal from the position detecting circuit (position detector) from a target position of the intermediate transfer belt and calculates the target speed of the intermediate transfer belt. The position controlling circuit outputs the target speed calculated to the speed controlling circuit. The speed controlling circuit calculates deviation of a speed signal that is input from the speed detecting circuit from the accurate target speed that is input from the position controlling circuit. The speed controlling circuit then calculates an accurate power that is to be supplied to a motor that drives the intermediate transfer belt and outputs the calculated power signal to the power converting circuit. Thus, by controlling the drive of the motor, the speed of the intermediate belt is adjusted accurately.

However, to carry out the accurate correction control to adjust the speed of the intermediate transfer belt to the target speed by detecting the speed of the intermediate transfer belt and carrying out a feed-back control, a feed-back control system that is equipped with a highly precise speed detecting system is required. Realization of such feed-back system results in an increase in the cost of the unit.

A small fluctuating frequency component of high frequency that is developed during operation of the image forming apparatus and fluctuating frequency component of low frequency that is developed due to change in the belt speed slowly are factors that contribute to a fluctuation in speed of the intermediate transfer belt (same in the case of the sheet carrier belt). The combination of the fluctuating frequency components of low frequency and the fluctuating frequency component of high frequency appear as fluctuation in speed of the belt. If all the factors that cause the fluctuation in speed of the belt are to be detected and if the correction is to be applied to all the factors, it is necessary to have a highly precise speed detecting system. Such system would be a very complicated one to be realized and will result in a very high rise in cost.

SUMMARY OF THE INVENTION

It is an object of the present invention to solve at least the problems in the conventional technology.

A transfer apparatus according to one aspect of the present invention includes a belt that rotates and carries either one of a plurality of images directly and a recording material with a plurality of images, a scale is provided along at least one side of entire of the belt; a sensor that reads the scale on the belt to obtain scale information; an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed.

An image forming apparatus according to another aspect of the present invention includes a belt that rotates and carries either one of a plurality of images directly and a recording material with a plurality of images, a scale is provided along at least one side of entire of the belt; and a transfer apparatus. The transfer apparatus includes a sensor that reads the scale on the belt to obtain scale information; an actual speed calculating unit that calculates a speed of the belt from the scale information; and a control unit that provides a control to correct speed of the belt according to the speed calculated. The control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed.

A method of correcting a speed of a belt according to still another aspect of the present invention includes reading a scale on the belt to obtain scale information, the belt being rotatable and carries either one of a plurality of images directly and a recording material with a plurality of images, a scale is provided along at least one side of a portion of the belt; calculating a speed of the belt from the scale information; and correcting fluctuating frequency component of low frequency smaller than a predetermined frequency that is developed during operation, from among the speed fluctuations of the belt to adjust the speed of the belt to a predetermined target speed.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention are described by referring to accompanying diagrams.

Figure 1:
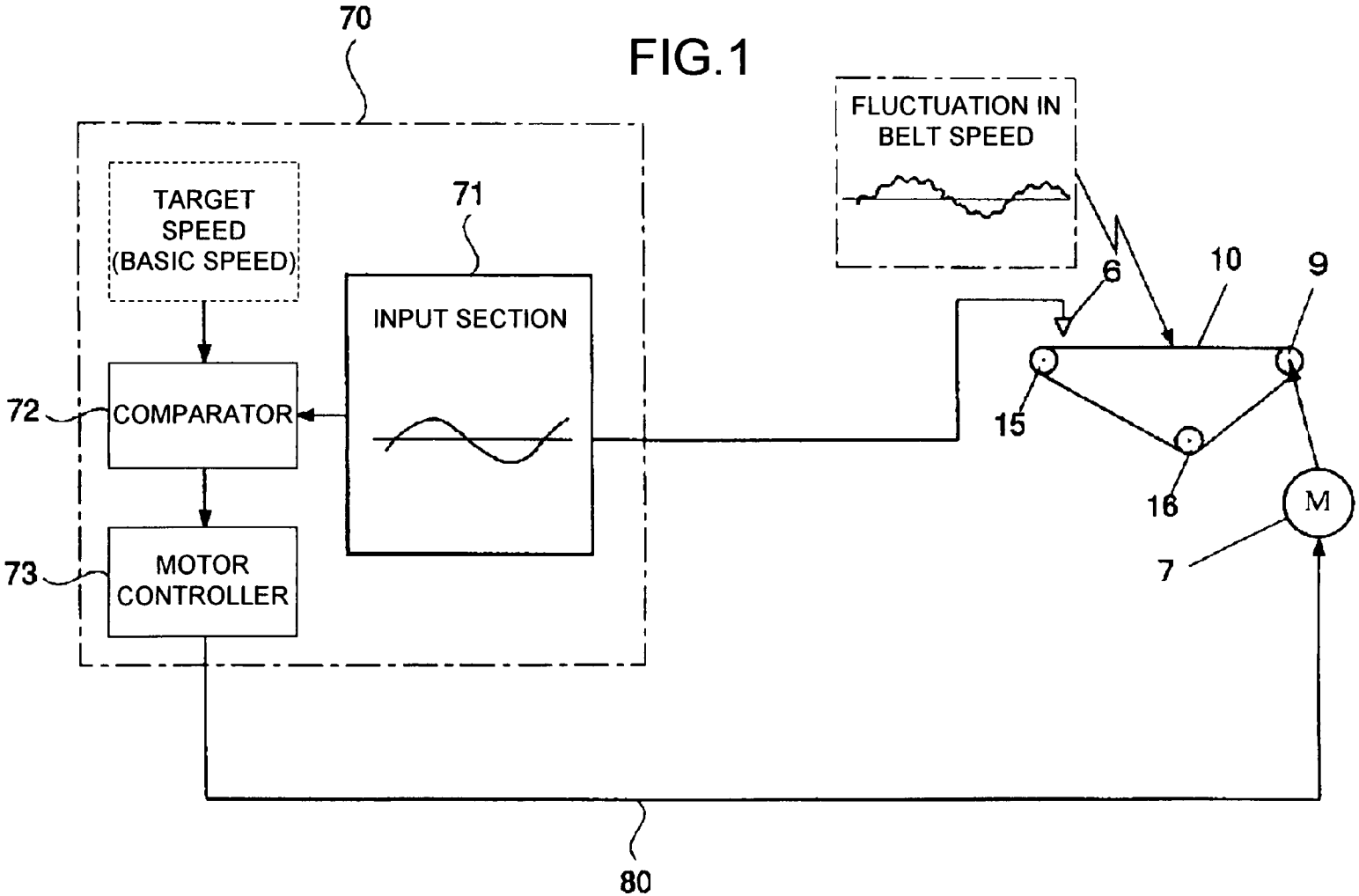
FIG. 1 is a schematic block diagram of a control system for controlling belt speed of a transferring unit according to an embodiment of the present invention.
Figure 2:
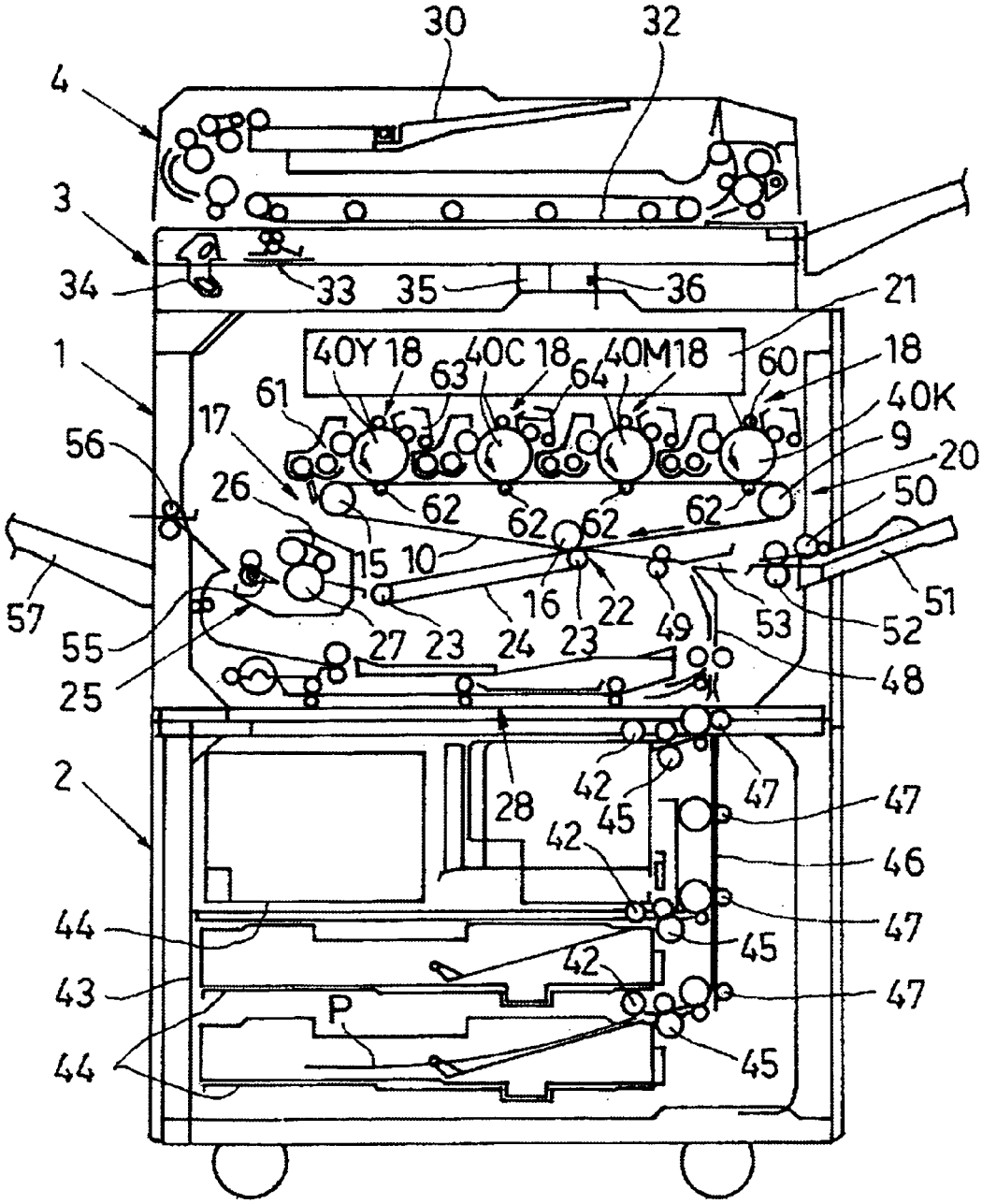
FIG. 2 is a schematic diagram of an image forming apparatus that is equipped with the transferring unit.

FIG. 1 is a schematic block diagram of a control system for controlling belt speed of a transferring unit according to a first embodiment of the present invention. FIG. 2 is a schematic diagram of an image forming apparatus that is equipped with the transferring unit.

A color copying machine that is shown as an example of the image forming apparatus in FIG. 2 is a tandem electrophotographic apparatus that includes an intermediate transfer belt 10 and a copying unit 1 that is mounted on a paper feeding table 2. A scanner 3 is mounted on the copying unit 1 and an automatic document feeder (ADF) 4 is mounted on the scanner 3.

The copying unit 1 includes a transferring unit 20 approximately at the center. The transferring unit 20 includes the intermediate transfer belt 10 which is an endless belt. The intermediate transfer belt 10 is stretched over a drive roller 9 and two driven rollers 15 and 16. The intermediate transfer belt 10 in FIG. 2 runs in clockwise direction. A cleaning unit 17 is provided on a left side of the driven roller 15. The cleaning unit 17 removes residual toner that is remained on the intermediate transfer belt 10 after transferring an image.

The copying unit 1 includes an image forming section 18 for four colors viz. yellow, cyan, magenta, and black that is installed above a straight part of the intermediate transfer belt 10 which is stretched over the drive roller 10 and the driven roller 15. The image forming section 18 includes photosensitive drums 40Y, 40C, 40M, and 40K (mentioned as photosensitive drums 40 when not specified separately) that are installed to rotate in anticlockwise direction in FIG. 2. Images (toner images) formed on these photosensitive drums are transferred directly to the intermediate transfer belt 10 one after another such that the image are superimposed.

The copying unit 1 includes a charging unit 60, a developing unit 61, a primary transferring unit 62, a cleaning unit 63 for cleaning the photosensitive drums, a decharging unit 64 that are installed around the photosensitive drums 40. An exposing unit 21 is installed above the photosensitive drums.

Further the copying unit 1 includes a secondary transferring unit 22 that is installed under an assembly of the intermediate transfer belt 10 stretched over the drive roller 9 and the driven rollers 15 and 16. The secondary transfer unit 1 transfers the images on the intermediate transfer belt 10 to a sheet P which is a recording material. The secondary transferring unit 22 includes a secondary transfer belt 24 which is an endless belt. The secondary transfer belt 24 is stretched over two rollers 23 and 23 and makes a pressed contact with the driven roller 16 via the intermediate transfer belt 10. The intermediate transferring unit 22 transfers the toner images on the intermediate transfer belt 10 collectively to the secondary transfer belt 24 where the secondary transfer belt is making a pressed contact with the intermediate transfer belt 10.

A fixing unit 25 that fixes the toner image on the sheet P is installed on a downstream side in a direction of sheet transfer by the secondary transferring unit 22. The fixing unit includes a pressurizing roller 27 that is in pressed contact with a fixing belt 26 which is an endless belt.

The secondary transferring unit 22 also performs a function of carrying a sheet to the fixing unit 25, after transferring the image. The secondary transferring unit may include a transfer roller or a non-contact charger.

A sheet inverting unit 28 is positioned beneath the secondary transferring unit 22. The sheet inverting unit 28 inverts the sheet when images are to be formed on both sides of the sheet.

In this color copying machine, a document is set on a feed tray 30 in the automatic document feeder 4 to make a color copy. For setting the document manually, the automatic document feeder 4 is opened to place the document on a contact glass 32 of the scanner 3 and the automatic document feeder 4 is closed to hold the document.

When a start switch that is not shown in the diagram is pressed, the document that is set on the automatic document feeder 4 is carried to the contact glass 32. If the document is set on the contact glass 32, the scanner starts immediately upon pressing the start switch and a first scanning component 33 and a second scanning component 34 starts moving. A light is irradiated from a light source of the first scanning component 33 towards the document and reflected light from the document surface is directed towards the second scanning component 34. The light directed towards the second scanning component 34 is reflected from a mirror in the second scanning component 34. The light reflected from the mirror passes through an image forming lens 35 and is incident on a sensor 36. Thus, the scanner 3 reads content on the document.

As the start switch is pressed, the intermediate transfer belt 10 starts running. At the same time, the photosensitive drums 40Y, 40C, 40M, and 40K also start rotating and formation of single colored images of yellow, cyan, magenta, and black colors on the photosensitive drums begins. The single colored images that are formed on the photosensitive drums are transferred one after another on the intermediate transfer belt 10 that is running in the clockwise direction in FIG. 2 such that the transferred images are superimposed. Thus, a full-color image is formed.

As the start switch is pressed, a paper feeding roller 42 in a selected paper feeding tray in the paper feeding table 2 starts rotating and a sheet P is fed from a paper feeding cassette 44 that is selected from a paper bank 43. Sheets that are fed from the paper feeding cassette 44 are separated one by one by a separating roller 45 and the separated sheets are carried to a paper feeding path 46.

The sheet P is carried to a paper feeding path 48 in the copying machine 1 by a transporting roller 47 and stops for a while upon striking a registering roller 49.

In a case of a bypass feed, the sheet P that is set on a bypass tray 51 is fed in by rotation of a paper feeding roller 50. The sheets fed in by the paper feeding roller 50 are separated and are carried to a bypass feeding path 53 one by one. The sheet P stops for a while upon striking the registering roller 49.

The registering roller 49 starts rotating at an accurate timing with the multiple-color image on the intermediate transfer belt 10. The sheet P that is at halt is carried to a position between the intermediate transfer belt 10 and the secondary transferring unit 22. A color image is transferred to the sheet P at the secondary transferring unit 22.

The secondary transferring unit which also performs the function of the carrying unit carries the sheet P that has the image transferred on it, to the fixing unit 25. The fixing unit 25 fixes the transferred image by supplying heat and applying pressure. Further, a guiding claw 55 directs the sheet P towards a (sheet) discharge side and a discharge roller 56 discharges the sheet P in a sheet discharge tray 57. The discharged sheet P is stacked in the sheet discharge tray 57.

When a duplex copy mode is selected, the guiding claw 55 carries the sheet P having an image formed on one side towards the sheet inverting unit 28. The sheet P that is inverted by the sheet inverting unit 28 is directed once again to a transferring position to form an image on a reverse side. After forming the image on the reverse side of the sheet P, the discharge roller 56 discharges the sheet P in the sheet discharge tray 57.

The transferring unit 20 includes the intermediate transfer belt 10, a sensor 6, and a controlling unit 80. The intermediate transfer belt 10 is running and the images on the plurality (four) of photosensitive drums 40Y, 40C, 40M, and 40K are transferred one after another to the intermediate transfer belt 10 such that the images are superimposed. The sensor 6 that is shown in FIG. 1 is disposed in a position where it can read a scale 5 (cannot be seen in FIG. 2, hence refer to FIG. 4) that is provided over the whole circumference on the outer side of the intermediate transfer belt. The sensor 6 detects actual speed of the intermediate transfer belt 10 from information that is obtained by detecting the scale 5. The controlling unit 70 performs correction control of the speed of the intermediate transfer belt 10 in accordance with the actual speed of the intermediate transfer belt 10 that is detected by the sensor 6.

The transferring unit 20 includes a feed-back loop 80 which functions as a frequency-correcting unit and applies a correction to a fluctuating frequency component of low frequency. The feed-back loop 80 performs correction of only fluctuating frequency component of low frequency that is developed due to change in the belt speed slowly, apart from a small fluctuating frequency component of high frequency that is developed during operation of the unit, from among the speed fluctuation of the intermediate transfer belt 10 and adjusts the speed of the intermediate transfer belt 10 to a target speed.

The speed fluctuation of the intermediate transfer belt 10 on periodic basis is attributable to factors like accuracy of thickness of the intermediate transfer belt 10, manufacturing error in components of the belt-driving system, and mechanical accumulated tolerance of layout of components.

Figure 3:
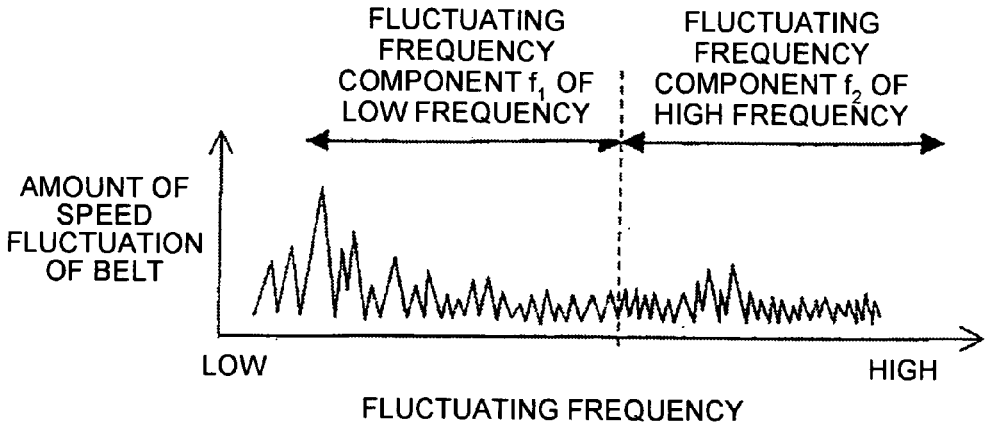
FIG. 3 is a graphical representation of a relationship between fluctuating frequency of the belt and an amount of speed fluctuation of the belt.

FIG. 3 is a graphical representation of a relationship between fluctuating frequency of the belt and an amount of speed fluctuation of the belt.

In this graph, it is the low-frequency component $f_1$ that causes the change in the belt speed that appears repeatedly on periodic basis and slowly, which is attributable to the factors like accuracy of thickness of the intermediate transfer belt 10, manufacturing error in the components of the belt-driving system, and mechanical accumulated tolerance of layout of components. It is the high-frequency component $f_2$ that is the fluctuating frequency, which is not attributable to the factors like accuracy of thickness of the intermediate transfer belt 10 and manufacturing error in the components of the belt-driving system. The high-frequency component $f_3$ is a fluctuating frequency component of low frequency that is developed during the operation of the apparatus due to factors like fluctuation in a pitch of gears of gear wheels that are used for transmission of rotations and closeness of the belt (from the rollers).

Thus, according to embodiments of the transferring unit, the image forming apparatus that is equipped with the transferring unit, and the method of belt-speed correction that is performed by using the transferring unit, the correction is applied to the belt speed in cases of belt-speed fluctuation by restricting the factors attributable to the belt-speed fluctuating, to the factors like accuracy of thickness of the intermediate transfer belt, manufacturing error in the components of the belt-driving system like rollers. Thus, the feed-back loop 80 (FIG. 9) is assembled at a low cost by neglecting the fluctuating frequency component of high frequency that hardly affects the image.

The controlling unit 70 includes a central processing unit CPU, a read only memory ROM, a random access memory RAM, and a microcomputer. The CPU has functions of making various judgments and processing. The ROM stores process (computer) programs and fixed data, and the RAM is a data memory that stores process data. The microcomputer includes an input and output (I/O) circuit.

The controlling unit 70 also includes an input section 71, a comparator 72, and a motor controller 73. The input section 71 inputs the fluctuating frequency component of low frequency among the speed fluctuations of the belt.

Information that is output from the input section 71 as well as the target speed (basic speed) of the intermediate transfer belt 10 are input to the comparator 72. The motor controller 73 performs drive control of a belt drive motor 7 that drives the intermediate transfer belt 10 according to information of belt speed from the comparator 72.

The input section 71 forms an extracting unit according to the present invention that inputs the fluctuating frequency component of low frequency and the comparator 72 and the motor controller 73 forms a correction control unit according to the present invention.

The comparator 72 compares an actual speed of the intermediate transfer belt 10 that is input from the input section 71 for the fluctuating frequency component of low frequency with the target speed of the intermediate transfer belt 10 and outputs a result of the comparison to the motor controller 73.

If the actual speed of the intermediate transfer belt 10 according to the information that is input, is within a speed range that can be judged to be same as the target speed of the intermediate transfer belt 10, the motor controller 73 continues to perform the drive control of the belt drive motor 7 with the same target speed. If the actual speed of the intermediate transfer belt 10 according to the information that is input, is beyond a speed range, that requires correction, the motor controller 73 controls rpm of the belt drive motor 7 according to the difference in the speed from the target speed, thereby applying the correction. Following is a detailed explanation of a belt-speed correction.

The motor controller 73 controls the rpm of the belt drive motor 7 to obtain the target speed in the beginning.

A driving system of the intermediate transfer belt 10 and a belt-speed detecting system for the intermediate transfer belt 10 are described by referring to FIGS. 4 to 6 below.

Figure 4:
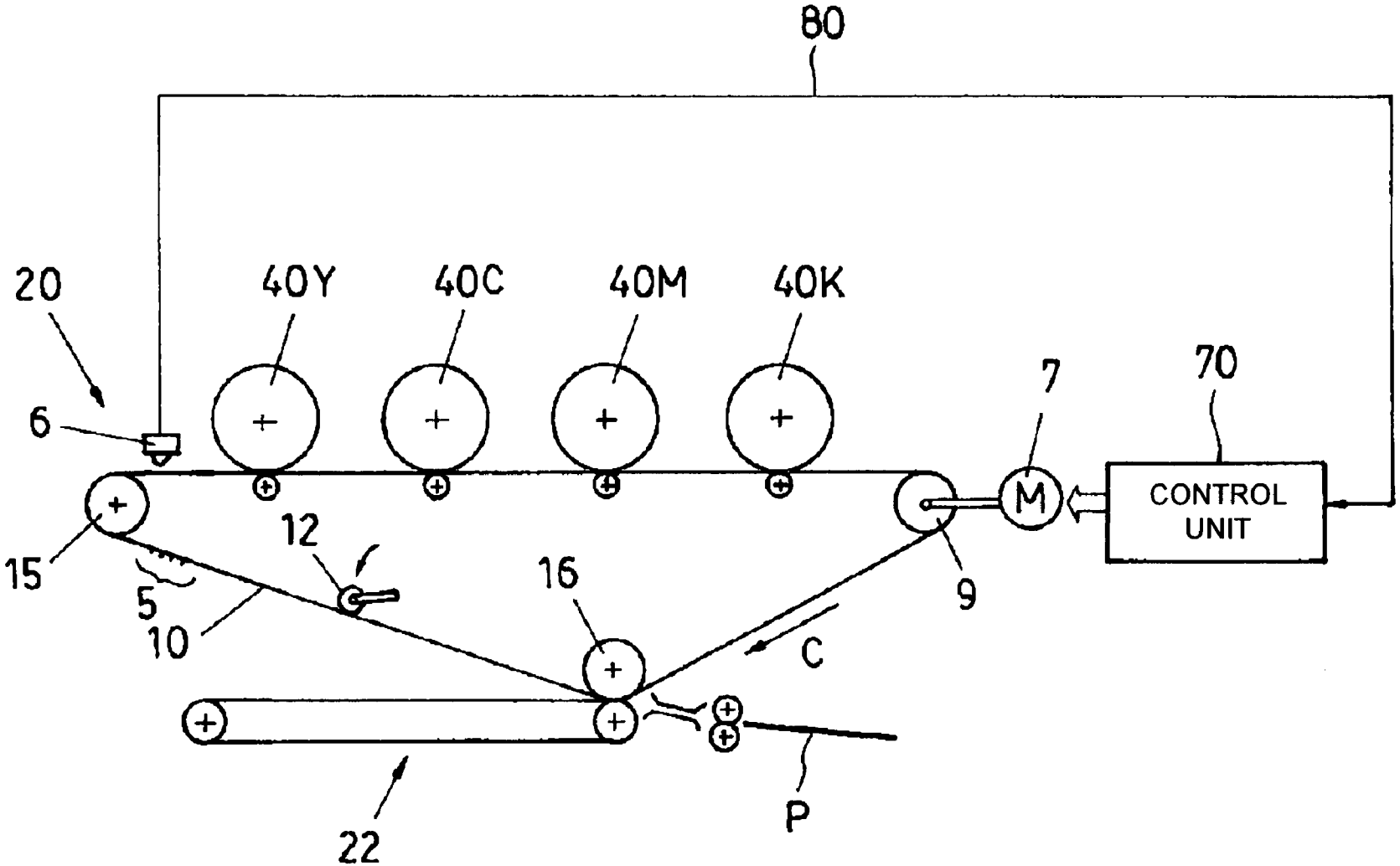
FIG. 4 is a schematic illustration of a drive system for an intermediate transfer belt and a system for speed detection of the intermediate transfer belt.

As shown in FIG. 4, rotation of the belt drive motor 7 stretches the intermediate transfer belt 10 so that the belt can be run, and transmits the drive to the drive roller 9 that drives the intermediate transfer belt 10. Measures such as forming a multiple number of knurled grooves on outer circumferential surface of the drive roller 9 to prevent slipping of the intermediate transfer belt 10 on the drive roller, applying a uniform coat of a material that increases friction on the outer circumferential surface of the drive roller 9 prove to be effective in increasing friction and preventing slipping of the intermediate transfer belt 10 over the drive belt 9.

The intermediate transfer belt 10 is formed by materials like a fluorine based resin, a polycarbonate resin, a polyimide resin. An elastic belt that has all layers or a part of layers formed by an elastic material is used as the intermediate transfer belt 10.

The intermediate transfer belt 10 is in pressed contact with a tension roller 12 with a predetermined tension applied on the belt.

The belt drive motor 7 runs the intermediate transfer belt 10 in a direction of an arrow C by rotating the drive roller 9. The transmission of the rotational drive may be directly from the belt drive motor 7 to the intermediate transfer belt 10 or may be through gears.

The single colored images (toner images) of different colors that are formed on the photosensitive drums 40Y, 40C, 40M, and 40K are transferred in an order of Y, C, M, and K one after another on the intermediate transfer belt 10 such that the transferred images are superimposed.

Figure 5:
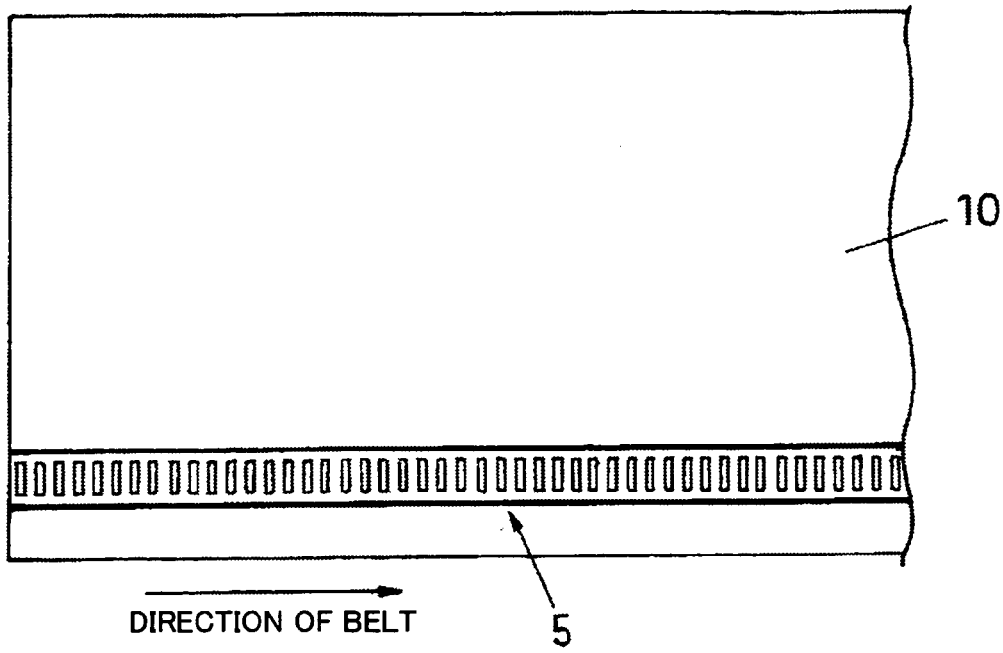
FIG. 5 is a top view of a part of the intermediate transfer belt provided with a scale along the whole circumference of the intermediate transfer belt to detect the belt speed.

The scale 5 is formed at an equal distance on the outer surface of the intermediate transfer belt 10 as shown in FIG. 5 along the whole circumference of the belt (only a part of the scale 5 is shown in FIG. 4). A position of the scale 5 along the direction of a width of the belt is a position that corresponds to an end of the photosensitive drums as shown in FIG. 5. The sensor 6 shown in FIG. 4 may be installed in any position provided the position enables detection of the scale on the surface of the belt that is stretched in a straight line between the drive roller 9 and the driven roller 15.

Figure 6:
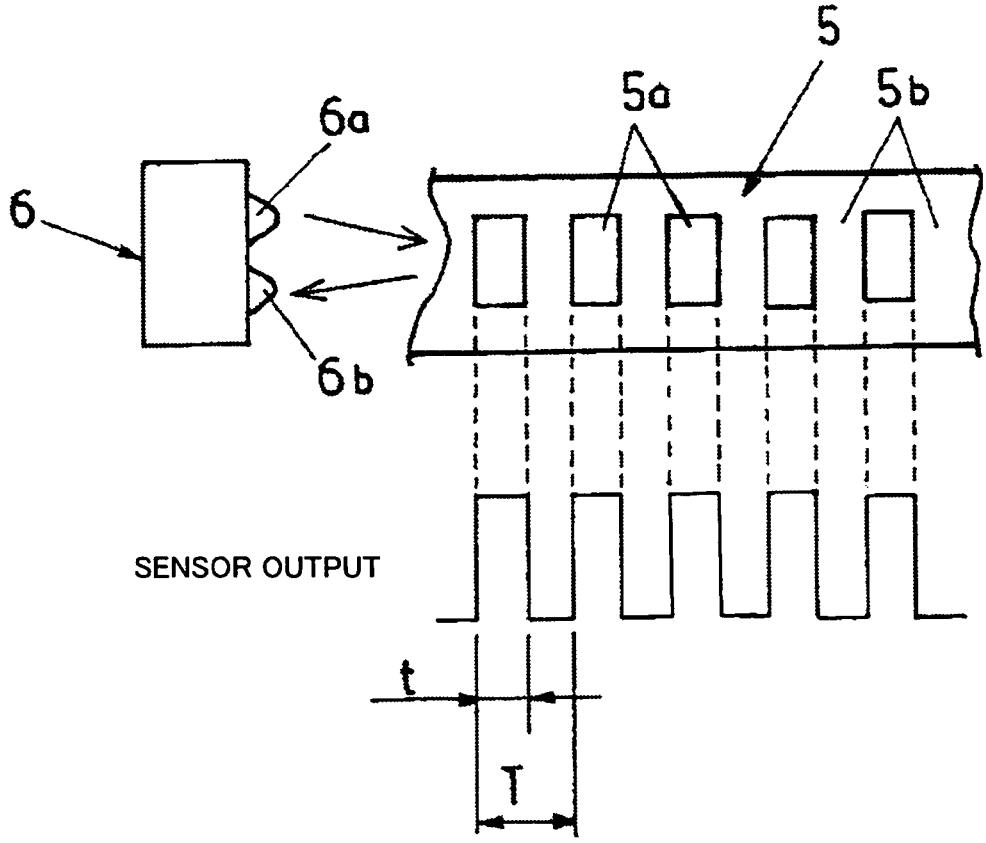
FIG. 6 is a schematic diagram of a sensor that reads the scale and a signal that is output by the sensor.

The sensor 6 is a reflecting optical sensor that includes a pair of light emission element 6*a* and a light receiving element 6*b* as shown in FIG. 6. Light is irradiated from the light emission element 6*a* towards the scale 5 and light reflected from the scale 5 is received by the light receiving element 6*b*. The sensor 6 detects the amount of light reflected from a slit 5*a* on the scale 5 and a part 5*b* that is other than the slit 5*a*, which are different.

The sensor 6 outputs signals of high and low values. This is due to difference in reflectivity of light reflected from the slit 5*a* and the part 5*b* that is other than slit 5*a*.

When the sensor 6 outputs the signal of high value upon receiving light by the light receiving element 6*b*, if the slit 5*a* on the scale is formed such that the reflectivity of the light reflected from the slit 5*a* is higher than the reflectivity of the light reflected from 5*b*, the signal that is output from the sensor 6 is an output during the time when the slit 5*a*, i.e. a range of t in FIG. 6, passes under the sensor 6. Therefore, as the intermediate transfer belt 10 runs, signals of high and low value are repeatedly output from the sensor 6 as shown in the diagram depending on whether the slit 5*a* or the 5*b* passes through a range of detection of the sensor 6.

Thus, by calculating time T from a point where the signal changed from low to high to a point where the signal changes from the next low to high, the speed of the surface of the intermediate transfer belt 10 (hereinafter, "belt speed") can be detected.

The method mentioned here is just an example of a method of detecting the speed of the intermediate transfer belt 10. Any sensor and scale that can detect the belt speed by detecting the scale that is formed on the intermediate transfer belt 10 may be used. The method of detecting may also be selected voluntarily.

Control of the belt speed of the intermediate transfer belt 10 is described below by referring to FIG. 7.

Figure 7:
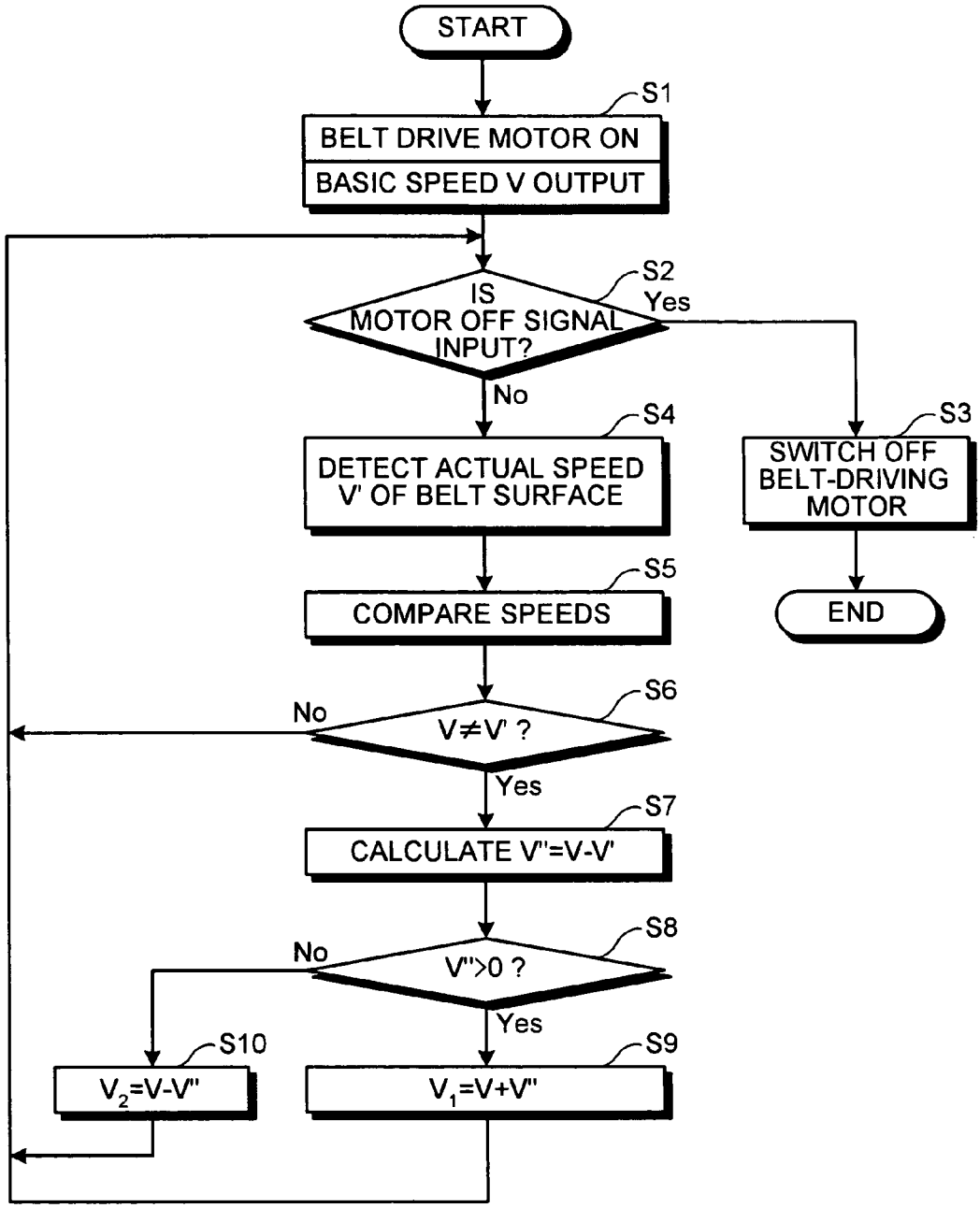
FIG. 7 is a flow chart of speed correction process of the intermediate transfer belt.

The microcomputer shown in FIG. 1 which includes the controlling unit 70 starts performing correction of the speed of the intermediate transfer belt that is shown in FIG. 7 at a predetermined timing. The microcomputer executes the following method for correction of the belt speed.

To start with, at step 1, the belt drive motor 7 is put ON and the belt drive motor 7 is allowed to attain a basic speed V which is the target speed (controlled by the motor controller 73 in FIG. 1). As the belt drive motor attains the basic speed V, the process advances to step 2. At step 2 a judgment of whether a signal (OFF signal) that puts the belt drive motor 7 OFF is input is made. If an OFF signal is input, the process advances to step 3. At step 3, the microcomputer puts the belt drive motor 7 OFF and ends the process.

If the OFF signal is not input at step 2 and the process advances to step 4, a signal that is fed-back from the sensor 6 is input and an actual speed V' of the surface of the intermediate transfer belt 10 is detected from information of the input signal. At step 5, the actual speed V' is compared with the basic speed V.

At step 6, a judgment of whether the basic speed V and the actual speed V' are same is made. If the basic speed V and the actual speed V' are same, i.e. if there is not difference in the two speeds (tolerable speed difference), the surface of the intermediate transfer belt 10 is judged to be running at the same speed as the basic speed. Therefore, the microcomputer continues to control the speed of the intermediate transfer belt at the basic speed V and the process returns to step 2, thereby repeating the judgment and the process.

If at step 6, the actual speed V' is judged to be different than the basic speed V, the process advances to step 7. At step 7, a difference in speed of the belt surface V" i.e. the difference between the actual speed of the intermediate transfer belt 10 and the basic speed V is calculated.

At step 8, a judgment of whether the speed difference V" is greater than zero is made. If the V" is judged to be greater than zero (Yes at step 8), the actual speed V' of the intermediate transfer belt 10 is judged to be slower than the basic speed V. Therefore, the microcomputer controls the rpm of the belt drive motor 7 such that the actual speed V' changes to a speed $V_1$, that is obtained by adding the speed difference V" to the basic speed V. Further, the process returns to step 2.

If at step 8, the speed difference V" is judged not to be greater than zero, the speed difference V" is less than zero and the actual speed V' of the surface of the intermediate transfer roller 10 is judged to be faster than the basic speed. Therefore, the process advances to step 10. At step 10, the microcomputer controls the rpm of the belt drive motor 7 such that the actual speed V' changes to a speed $V_2$ that is obtained by subtracting the speed difference V" from the basic speed V and the process returns to step 2.

Further, the microcomputer performs correction control so that the actual speed V' of the surface of the intermediate transfer belt 10 becomes same as the basic speed V by repeating the judgments and process of step 2 onward. At step 2, if the signal that puts the belt drive motor 7 OFF is judged to be input, the process advances to step 3. At step 3, the microcomputer puts the belt drive motor 7 OFF and ends the process.

However, the speed fluctuation in the intermediate transfer belt 10 is due only to the fluctuating frequency component of low frequency that is developed due to change in the belt speed slowly, apart from a small fluctuating frequency component of high frequency that is developed during operation of the unit.

Figure 8:
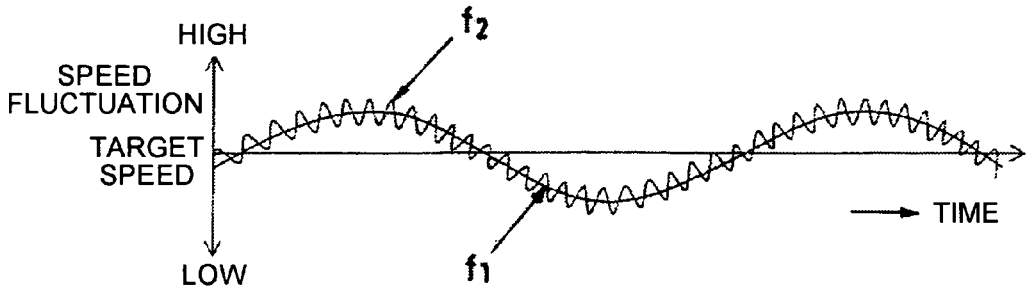
FIG. 8 is a graphical illustration of a fluctuating frequency component of high frequency and a fluctuating frequency component of low frequency in speed fluctuation of the belt.

A graph is plotted as shown in FIG. 8 of the fluctuating frequency component of high frequency and the fluctuating frequency component of low frequency in the speed fluctuation by taking rotating time on a horizontal axis and the speed fluctuation on a vertical axis and the target speed of the belt (which is an ideal basic speed) is indicated by a straight line at the center of the speed fluctuation. According to the graph, the speed fluctuation where the speed changes comparatively slowly as shown in the diagram during one full turn (one cycle) of the intermediate transfer belt 10, becomes the fluctuating frequency component $f_1$ of low frequency (hereinafter, "low-frequency component $f_1$) and the speed fluctuation where the speed changes little by little instantaneously becomes the fluctuating frequency component $f_2$ of high frequency (hereinafter, "high-frequency component $f_2$).

The low-frequency component $f_2$ is a fluctuating frequency component that appears repeatedly on periodic basis due to the intermediate transfer belt 10 or the components of the belt-driving system like the drive roller 9 and the tension roller 12 of the intermediate transfer belt 10 that are shown in FIG. 4.

To apply correction to both the low-frequency component $f_1$ and the high-frequency component $f_2$ in the speed fluctuation, it is necessary to adjust a correction-frequency range on the higher frequency side, which necessitates a highly precise and complicated control circuit. The reason is that the accuracy of correction depends on an accuracy of detection by the sensor and a cycle of a control loop.

Figure 9:
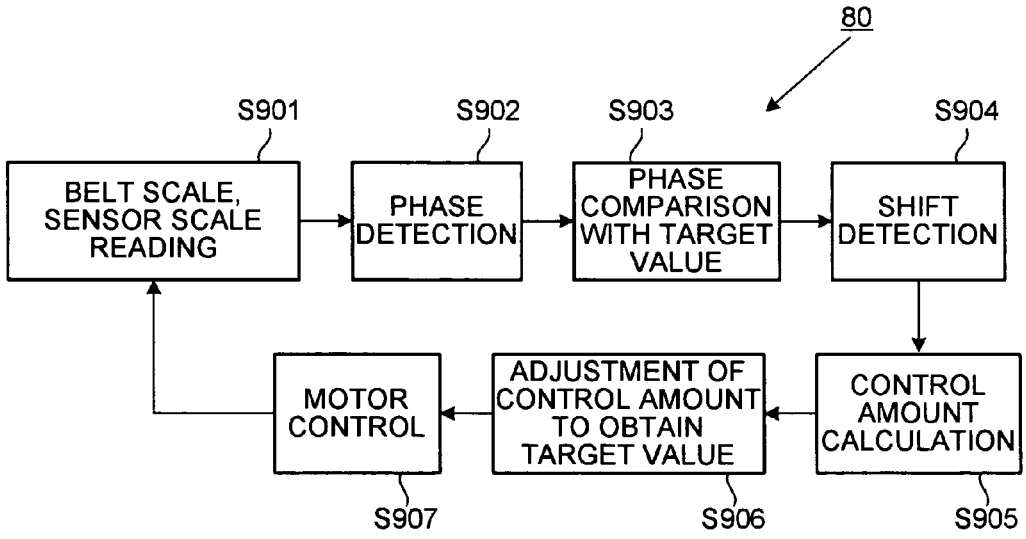
FIG. 9 is a block diagram of a feed-back loop for a series of controls related to speed correction of the intermediate transfer belt performed by the transferring unit in FIG. 4.
Figure 10:
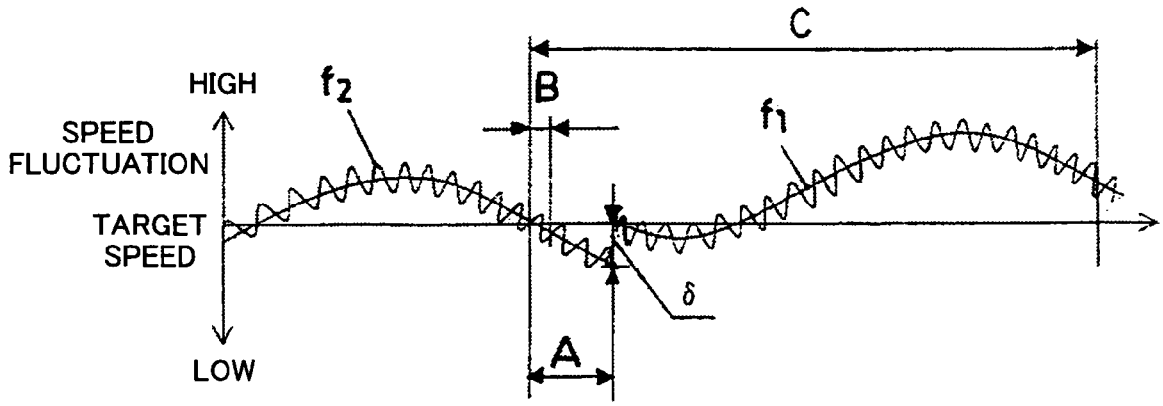
FIG. 10 is a graphical representation of illustration of a fact that if a high-frequency cycle of the high-frequency component in the speed fluctuation of the belt is faster than a cycle of a control loop, the correction cannot be applied to speed fluctuation of the high-frequency component.

The accuracy of correction is described by referring to FIGS. 9 and 10.

FIG. 9 is a block diagram of the feed-back loop 80 that functions as a frequency-correcting unit for correction of the fluctuating frequency component of low frequency in the transferring unit. The feed-back loop 80 reads the scale 5 that is provided along the overall circumference of the intermediate transfer belt 10 with the sensor 6 (step S901) and detects the actual speed of the intermediate transfer belt 10 from the scale 5 that is detected by the sensor 6. The input section 71 extracts a phase of the fluctuating frequency component of low frequency from the speed fluctuations (step S902). The comparator 72 compares the phase of the fluctuating frequency component of low frequency with the target speed (step S903) and an amount of shift is detected (step S904). The feed-back loop 80 calculates the amount of speed that is to be added to or subtracted from the actual speed (step S905) and controls the belt drive motor 7 according to the actual speed of the intermediate transfer belt 10 (step S906) and performs correction control of the intermediate transfer belt 10, thereby executing the method of belt-speed correction.

In this method of belt-speed correction control the correction is applied only to the low-frequency component $f_1$, that is developed due to change in the belt speed slowly, apart from a small high-frequency component $f_2$ that is developed during operation of the unit that is described in FIG. 8, from among the speed fluctuation of the belt. Concretely, all frequency components of the speed fluctuations of the belt are input to the input section 71. The input section 71 extracts the low-frequency component $f_1$, and outputs the low-frequency component $f_1$, to the comparator 72. A low-pass filter circuit can be used as the input section 71.

The feed-back loop 80 reads the scale 5 on the intermediate transfer belt 10 with the sensor 6 and detects an actual phase of the intermediate transfer belt 10 from the scale detected. The feed-back loop 80 compares the phase with the target value and detects an amount of shift. Based on the amount of shift, the feed-back loop 80 calculates the amount to be added to or subtracted from the actual speed value that is required to match the speed of the intermediate transfer belt 10 with the target speed. The addition or subtraction from the actual speed value, as is described by referring to the flow chart in FIG. 6, is judged according to the actual speed of the intermediate transfer belt 10 with respect to the target speed, i.e. whether the actual speed is faster or slower than the target speed.

Further, the rpm of the belt drive motor 7 is controlled according to the amount added to or subtracted from the actual speed value to match the speed of the intermediate transfer belt 10 with the target speed. Thus, the feed-back loop 80 performs the feed-back control to match the speed of the intermediate transfer belt 10 with the target speed.

Let one cycle of the control loop of the feed-back loop 80 be a cycle A. If the cycle A of the control loop is substantially shorter than a low-frequency cycle C of the low-frequency component $f_1$, an amount of shift control δ that is shown in FIG. 10 can be detected. Therefore, the speed of the intermediate transfer belt 10 can be matched with the target speed by applying correction to the amount of shift control δ which is a difference between the actual speed and the target speed (basic speed) at the end of one control loop of the feed-back loop 80.

In other words, if A is greater than C (i.e. the cycle A is substantially faster than the low-frequency cycle C) the correction can be applied to the amount of shift-control δ.

However, since a high-frequency cycle B of the high-frequency component $f_2$ becomes shorter than the cycle A of the control loop of the feed-back loop 80 as shown in FIG. 10, the speed fluctuation of the high-frequency component $f_2$ of the intermediate transfer belt 10 that appears as the high frequency cycle B cannot be detected. As a result, the correction cannot be applied to the high-frequency component $f_2$. In other words, if B is greater than A (i.e. the high-frequency cycle B is faster than the cycle A), the correction cannot be applied to the speed fluctuation of the high-frequency component $f_2$ of the intermediate transfer belt 10.

Therefore, if a correction is to be applied to the speed fluctuation of the high-frequency component $f_2$, it is necessary to form a control loop having a cycle that is shorter than that of the high-frequency component $f_2$.

In general, in order to accommodate the speed fluctuation in a control range, it is supposed that there is a need to apply the correction with a cycle that is tens of times of the frequency to which the correction is to be applied. Therefore, if a correction is to be applied to the speed fluctuation of the high-frequency component $f_2$ of the intermediate transfer belt 10 that appears as the high-frequency cycle B, the cycle of the control loop for applying the correction is required to be shortened substantially. To realize this, each components in the control loop need to have improved accuracy by providing an amplifying filter circuit etc. and minimum unevenness.

Moreover, it is necessary to improve the accuracy of the sensor that detects the speed of the intermediate transfer belt 10. The scale that is provided on the intermediate transfer belt 10 also needs to have high resolution as well as high accuracy. Fabrication of such highly accurate components is very difficult and realization of such components leads to a high-cost system.

Therefore, in the transferring unit and the image forming apparatus that is equipped with the transferring unit according to the first embodiment, focus is mainly on applying correction to the belt speed for the speed fluctuation of the low-frequency component $f_1$ for which the correction to the belt speed can be applied easily as compared to applying correction to the speed fluctuation of the high-frequency component $f_2$ of the intermediate transfer belt 10. The transferring unit and the image forming apparatus that is equipped with the transferring unit according to the first embodiment are provided with the feed-back loop 80 that is described by referring to FIG. 9, which functions as the frequency-correcting unit that performs correction of only the fluctuating frequency component of low frequency to match the speed of the intermediate transfer belt to the target speed by applying correction only to the fluctuating frequency component of low frequency that is developed due to change in the belt speed slowly, apart from the small fluctuating frequency component of high frequency that is developed during operation of the unit, from among the speed fluctuation of the intermediate transfer belt 10.

In the feed-back loop 80, the correction of the speed fluctuation of the high-frequency component $f_2$ is not performed. Even without performing the correction, there is no adverse effect on the image. This is described below by referring to FIG. 11.

Figure 11:
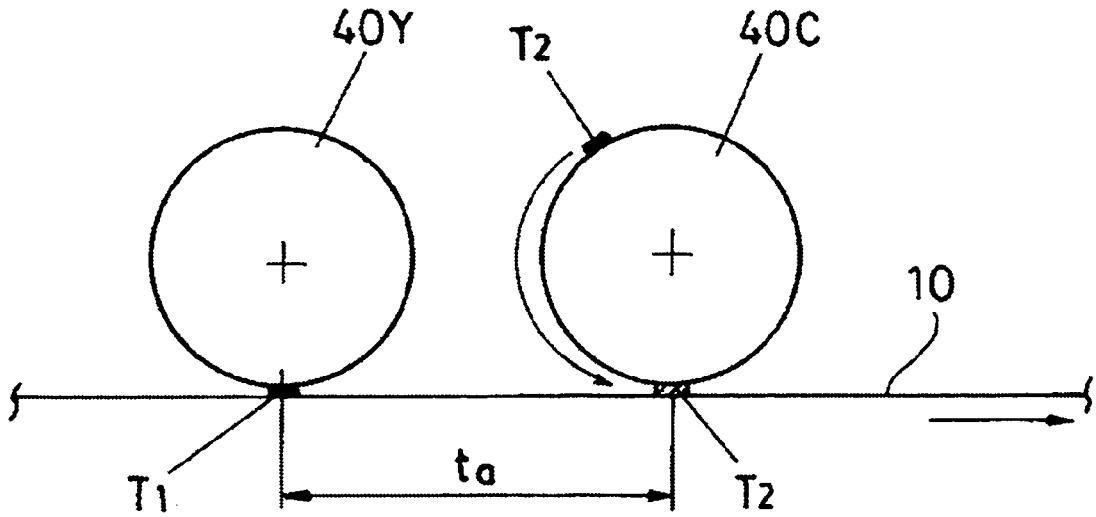
FIG. 11 is an illustration of a relationship of a belt speed with difference in transfer time leading to color shift.

In a case of the tandem color image forming apparatus, as shown in FIG. 11, it is a common practice to arrange a plurality of photosensitive drums 40Y, 40C (only two drums are shown in FIG. 11 to facilitate the description) with a certain distance between the drums, above a stretched portion of the intermediate transfer belt 10 in straight line. Due to such arrangement, transferring of a toner image on the photosensitive drum to the same position on the intermediate transfer belt 10 simultaneously is practically impossible.

Concretely, after a toner image $T_1$ of a first color on the photosensitive drum 40Y is transferred to the intermediate transfer belt 10, there is a time difference ta till the toner image $T_1$ on the intermediate transfer belt 10 is shifted to a transferring position of the photosensitive drum 40C to which a toner image $T_2$ of a second color is formed. When the toner image $T_1$ of the first color reaches the transferring position of the photosensitive drum 40C, the toner image $T_2$ of the second color on the photosensitive drum 40C is transferred so that the toner image $T_2$ is superimposed on the toner image $T_1$ of the first color.

Thus, in a case of forming a color image of a plurality of colors by using the tandem color image forming apparatus that includes a plurality of photosensitive drums, there is a time difference (ta in FIG. 11) between a first image transfer and a second image transfer. In a case of a full-color image, a third color image and a fourth color image are transferred with a time difference so that the images are superimposed. Thus, an image in which the four color images are superimposed on the same position is formed.

While forming such image, if there is a speed fluctuation of the intermediate transfer belt 10 of a low-frequency cycle that is slower than the time difference ta in transferring timings of the images from the photosensitive drum 40Y for the first color and the subsequent photosensitive drum 40C for the second color, the image of the second color that is transferred to the intermediate transfer belt 10 reaches the transferring position of the image of the second color with a delay equivalent to the speed fluctuation of the belt with respect to the position of the image of the first color, i.e. a regular position. As a result, there is a color shift.

Conversely, if there is a speed fluctuation of the intermediate transfer belt 10 of a low frequency cycle that is faster than the target speed, the image of the second color reaches the transferring position of the image of the second color earlier by the amount of speed fluctuation of the belt with respect to the position of the image of the first color. As a result, there is a color shift.

However, even there is a speed fluctuation of the high-frequency component $f_2$ which is a cycle shorter than a time in which the intermediate transfer belt 10 runs at the target speed from the transferring position of the image of the first color to the transferring position of the image of the second color, when the intermediate transfer belt 10 reaches the transferring position of the image of the second color, if the speed of the intermediate transfer belt 10 is returned to the target speed, there is no position shift of the overall intermediate transfer belt 10. Therefore the image of the second color is superimposed on the image position of the first color on the intermediate transfer belt 10. Similarly, the images of the third color and the fourth color are superimposed. Therefore, there is hardly any color shift upon forming a four colored full-color image, and even if there is any color shift, it is almost negligible to the extent that it is not even remarkable as the color shift on the image.

Thus, according to the first embodiment, the color shift can be prevented even by applying the correction to the target speed of the intermediate transfer belt 10 by performing the correction of only the fluctuating frequency component of low frequency that is developed due to change in the belt speed slowly, apart from the small fluctuating frequency component of high frequency from among the speed fluctuation of the intermediate transfer belt 10.

Generally, the high-frequency cycle is not less than a few kHz, whereas the low-frequency cycle is not greater than tens of Hz. Therefore, the feed-back loop 80 shown in FIG. 9 that uses the low-frequency cycle can be assembled at a low cost.

However, a cause of appearing of the low-frequency component $f_1$ among the speed fluctuation of the intermediate transfer belt 10 as the low-frequency cycle C that is described in FIG. 10 lies mainly in one cycle (one turn) of the intermediate transfer belt 10.

The reason for this is as follows. The color copying machine (FIG. 2) according to the first embodiment is a tandem color copying machine in which a transferring sheet of comparatively bigger size like A3 can be used. Therefore, circumference of the intermediate transfer belt is comparatively longer and the time taken for one turn of the intermediate transfer belt 10 is longer compared to the control loop cycle A (FIG. 10) in the control loop that is described in FIG. 9.

Factors that are attributable to the belt-speed fluctuation of low frequency are described below in detail.

Figure 12:
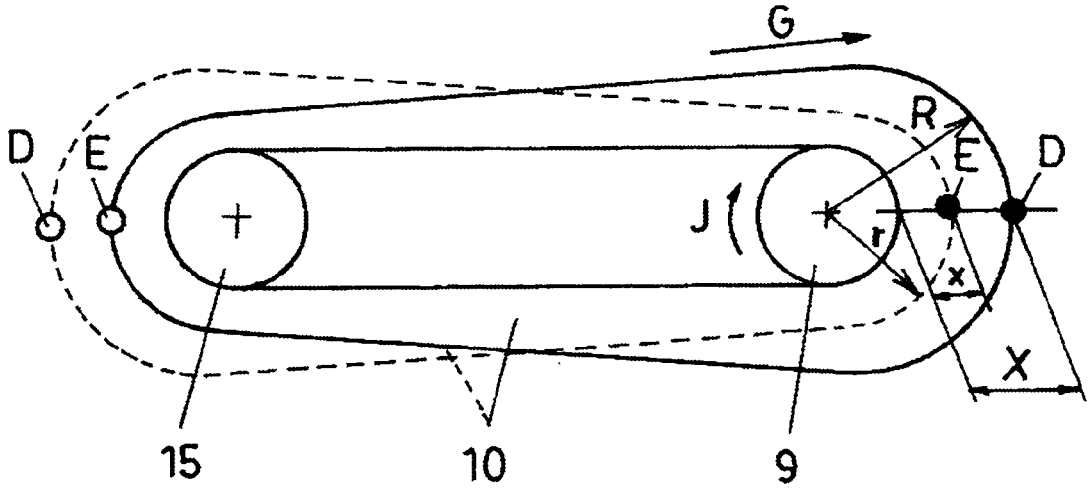
FIG. 12 is an illustration of fluctuations in the speed of the surface of the intermediate transfer belt caused by unevenness in thickness of the intermediate transfer belt.
Figure 13:
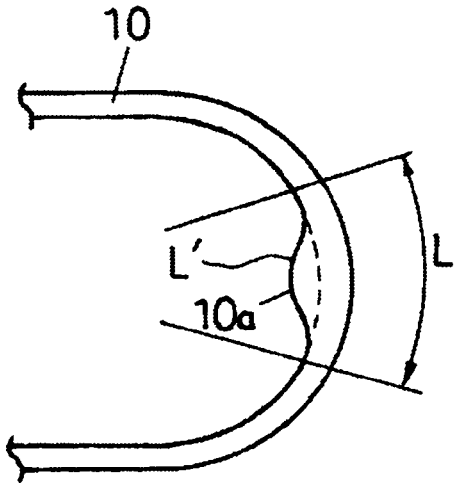
FIG. 13 is an illustration of fluctuations in the speed of the intermediate transfer belt caused by unevenness in thickness of the intermediate transfer belt.

To start with, a case in which the speed fluctuation due to the fluctuating frequency component of low frequency of the intermediate transfer roller 10 is attributable to unevenness in thickness of the intermediate transfer belt 10 is described by referring to FIGS. 12 and 13.

FIG. 12 is an illustration of the fluctuation in the speed of the surface of the intermediate transfer belt 10 due to the unevenness in thickness of the intermediate transfer belt 10.

In FIG. 12, to facilitate the description for convenience, the intermediate transfer belt 10 is stretched over two rollers viz. the drive roller 9 and the driven roller 15 (refer to FIG. 4 for the actual number of rollers). Moreover, for the purpose of facilitating the description, the unevenness in thickness of the intermediate transfer belt 10 is represented by one point each of a thick portion and a thin portion of the belt. However, even if the unevenness in thickness of the belt is at a plurality of points on the belt, the following description is applicable similarly to such cases as well.

The intermediate transfer belt 10 is stretched over the drive roller 9 and the driven roller 15 and can be run in a direction indicated by an arrow G. The intermediate transfer belt 10 runs in the direction of the arrow G upon rotating of the drive roller 9 in a direction indicated by an arrow J.

In FIG. 12, the thickness of the intermediate transfer belt 10 is the maximum at a point D and the thickness of the intermediate transfer belt 10 is the minimum at a point E. The intermediate transfer belt 10, when the point D is at a position on a side of the drive roller 9 as shown in the diagram and the point E is at a position on a side of the driven roller 15 as shown in the diagram, is shown by a continuous line.

Upon running of the intermediate transfer belt 10, the point D comes to a position on the side of the driven roller 15 and the point E comes to a position on the side of the drive roller 9. The intermediate transfer belt 10 in such condition is shown by a broken line.

The thickness of the belt at the point D when the point D is on the side of the drive roller 9 is indicated by X and the thickness of the belt at the point E when the point E is on the side of the drive roller 9 is indicated by x. Thus, X is greater than x.

In this case, since the description is based on an assumption that the drive roller 9 is not eccentric, the radius of the drive roller 9 is constant. Therefore, radius (maximum radius) of the belt rotation from a center of rotation of the drive roller 9 to the point D on the surface of the belt is R and radius (minimum radius) of the belt rotation up to the point E is r. The difference between the two radii R−r is same as X−x, i.e. (R−r)=(X−x).

In this case, since the radii of rotation R and r are different, the speed of the surface of the intermediate transfer belt 10 at the point D is faster than that at the point E on the belt surface.

Concretely, the intermediate transfer belt 10 runs in the direction of the arrow G and when the point D at which the thickness of the belt is more as compared to any other part of the belt, reaches the position on the side of the drive roller 9, the speed of the belt surface becomes maximum and if the belt continues to run, the speed of the belt surface decreases gradually. When the point E at which the thickness of the belt is minimum, reaches the position on the side of the drive roller 9, the speed of the belt surface becomes minimum. Thus, the difference in speeds of the surface of the belt appears as unevenness in the belt speed.

In a case of the model described, the unevenness in the speed of the surface of the belt is remarkable at a portion of the drive roller where the intermediate transfer belt 10 bends in a shape of circular arc and the unevenness in the speed of surface of the belt decreases when the position is away from the drive roller.

Fluctuation in speed of the surface of the intermediate transfer belt 10 due to the unevenness in thickness of the intermediate transfer belt is described from a different viewpoint by using another illustration model that is shown in FIG. 13.

FIG. 13 is an illustration of a case in which there is unevenness in thickness of the belt which is caused due to a bulge on an inner side of the intermediate transfer belt 10. In this case, when the intermediate transfer belt 10 is in a position that is on the circular arc portion of the drive roller 9 as shown in the diagram (omitted in FIG. 13 to avoid complications. Refer to FIG. 12), if a distance of an inner circumferential surface along the circular arc portion when a portion that is indicated by a broken line when a bulge 10*a*, is not there, is distance L and if a distance of an inner circumferential surface along the circular arc portion when the bulge 10*a* is there, is L', then the distance L' is longer than the distance L, without any doubt.

As a result, since the roller 9 is in contact with the inner surface of the intermediate transfer belt 10 and moves the intermediate transfer belt 10, unless the drive roller 9 moves the intermediate transfer belt 10 additionally (more) by an amount of difference of the distances L'−L when the bulge 10*a* is there, as compared to the case when the bulge 10*a* is not there, the drive roller 9 cannot move the intermediate transfer belt 10 through the same distance as in the case when the bulge is not there. In other words, the speed of the intermediate transfer belt is slowed down by the amount of the difference between the distances L'−L. As a result, in this case, the speed of the intermediate transfer belt 10 at a position on the straight portion of the belt away from the drive roller 9, decreases.

Thus, the uneven thickness of the intermediate transfer belt 10 causes fluctuations in the belt speed. However, it is impossible to manufacture a belt without unevenness in thickness. Therefore, the unevenness in speed that is caused due to the unevenness in the thickness of the intermediate transfer belt is unavoidable.

Moreover, since the unevenness in the thickness of the belt tend to be developed at lesser points around the circumference of the belt, the unevenness in the thickness of the belt appears as the low-frequency cycle. Therefore, the unevenness in the thickness of the belt causes the position shift during formation of a color image, which results in the color shift on the image.

The unevenness in the thickness of the belt is normally not greater than a few Hz due to the manufacturing process.

Thus, according to the first embodiment, by focusing on the point that the speed fluctuation of the intermediate transfer belt 10 due to the fluctuating frequency component of low frequency is attributable to the unevenness in the thickness of the intermediate transfer belt 10, the correction is applied to the unevenness in speed that is caused due to the unevenness in the thickness by using the feed-back loop 80 that is shown in FIG. 9, thereby enabling to deal with a problem by using a low cost assembly.

Furthermore, by restricting the frequency to which the correction is applied, it is possible to restrict a range of phase detection in the feed-back control. As a result, a comparison of phases of the target speed and the detection of amount of shift of the speed can be performed precisely, thereby enabling a stabilized control of the belt speed.

A case in which the speed fluctuation due to the fluctuating frequency component of low frequency of the belt is attributable to an eccentricity of the drive roller which is a component in the belt-driving system that drives the intermediate transfer belt, is described below by referring to FIG. 14.

Figure 14:
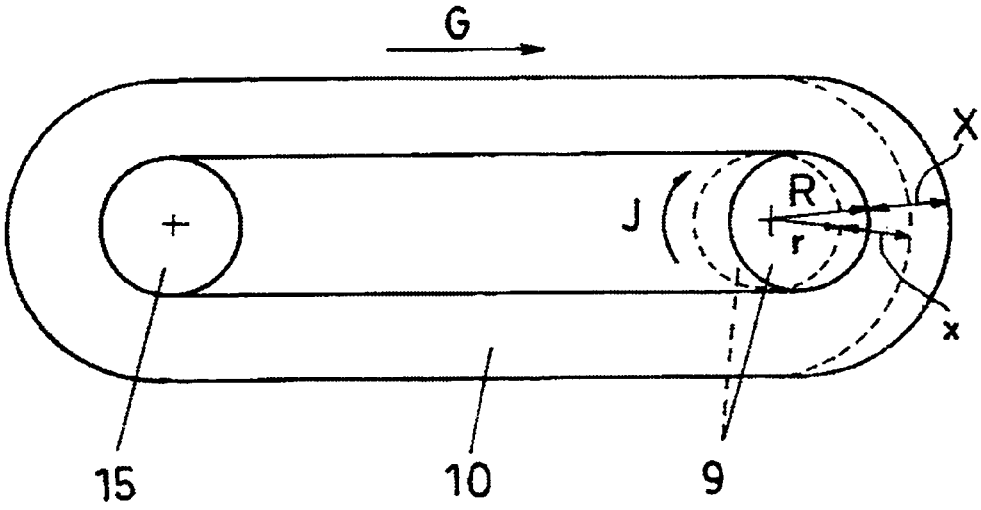
FIG. 14 is an illustration of fluctuations in the speed of the intermediate transfer belt caused by an eccentricity of a drive roller.

In FIG. 14, to facilitate the description for convenience, the intermediate transfer belt 10 (thickness of the belt is emphasized in the diagram) is stretched over two rollers viz. the drive roller 9 and the driven roller 15 (refer to FIG. 4 for the actual number of rollers). The intermediate transfer belt 10 can be run in a direction indicated by an arrow G by the drive roller 9 and the driven roller 15. The intermediate transfer belt 10 runs in the direction of the arrow G upon rotating of the drive roller 9 in a direction indicated by an arrow J.

As shown in the diagram, the drive roller 9 is eccentric. Radius from a center of rotation of the roller in a position of maximum eccentricity where the drive roller 9 is protruding to the maximum extent in a direction of a contact with the belt to the contact surface of the belt, is R. Radius from the center of rotation of the roller in a position of minimum eccentricity where the drive roller 9 is protruding to the maximum extent in a direction opposite to the contact with the belt to the contact surface of the belt, is r.

In this case, to facilitate the description, the thickness of the intermediate transfer belt 10 is assumed to be uniform (X=x). The difference in speeds of the surface of the belt when the belt is driven, when the drive roller 9 is in the position of the maximum eccentricity (when the drive roller 9 is protruding to the maximum extent) and when the belt is driven, when the drive roller 9 is in the position of the minimum eccentricity, is (R−r). Therefore, there is a fluctuation equivalent to this speed difference in the speed of the surface of the intermediate transfer belt 10.

In general, since a majority of drive rollers have bigger radius, the speed fluctuation tend to appear as a low frequency cycle. Therefore, the speed fluctuation results in the position shift of the image and tend to appear as unevenness in color in the image.

The low frequency cycle, in general, is in a range of a few Hz to tens of Hz. Therefore the focus is put on the eccentricity of the drive roller which is a cause of the speed fluctuation due to the fluctuating frequency component of low frequency and the correction is applied only to the speed fluctuation that is due to the fluctuating frequency component of low frequency. Thus it is possible to realize stabilized speed control at a low cost.

The accuracy of correction is improved further by applying correction to the speed fluctuation due to the fluctuating frequency component of low frequency of the belt that includes the change in the amount of eccentricity of the drive roller due to the change in environment temperature.

Figure 15:
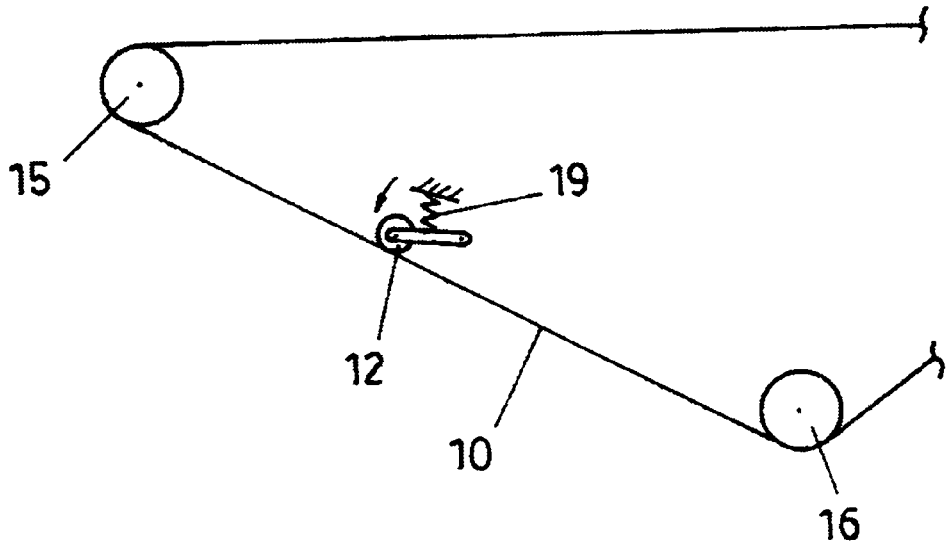
FIG. 15 is an illustration of fluctuations in the speed of the intermediate transfer belt caused by fluctuations in thrust exerted by a tension roller.

A case in which the speed fluctuation due to the fluctuating frequency component of low frequency is attributable to the fluctuation in the thrust exerted by the tension roller which is a component in the belt-driving system that drives the intermediate transfer belt, is described below by referring to FIG. 15.

The tension roller 12 is in contact with the intermediate transfer belt 10 and stretches the belt with a predetermined tension. The tension roller 12 as well, is a factor that causes the speed fluctuation in the fluctuating frequency component of low frequency of the intermediate transfer belt 10 due to the fluctuation of the thrust that the tension roller 12 exerts on the intermediate transfer belt 10.

Concretely, the tension roller 12 presses against the surface of the intermediate transfer belt 10 with a predetermined thrust due to a biasing member 19, like a spring. If there is a speed fluctuation of the intermediate transfer belt 10 on periodic basis, the tension in the belt changes with the speed fluctuation. The change in the belt tension causes change in the reaction force that is exerted by the surface of the belt. As a result there is a fluctuation in the thrust that is exerted on the intermediate transfer belt 10.

Due to the fluctuation in the thrust, there is a change in the thrust exerted on the intermediate transfer belt 10 by the tension roller 12 which results in the speed fluctuation of the intermediate transfer belt 10 on periodic basis. This speed fluctuation of the intermediate transfer belt 10 is due to the fluctuating frequency component of low frequency similar to the speed fluctuation that is attributable to the unevenness in thickness of the intermediate transfer belt 10 and the eccentricity of the drive roller 9. The correction can be easily applied to the speed fluctuation of the low frequency due to the thrust, at a low cost, thereby enabling stabilized speed control.

The speed fluctuation of the belt may be attributable to both the factors viz. the unevenness in the thickness of the intermediate transfer roller 10 and the eccentricity of the drive roller 9 and to the combination of all the factors viz. the unevenness in the thickness of the belt, the eccentricity of the drive roller 9, and the fluctuation in the thrust exerted by the tension roller 12.

However, there are various factors that are attributable to the speed fluctuation of the intermediate transfer belt 10 and the correction to be applied to the speed of the belt when there is a speed fluctuation of the belt due to the low-frequency cycle, is already described.

The actual factors which are attributable to the speed fluctuation of the belt with a low-frequency cycle vary depending on the system configuration of the unit. Concretely, actual factors vary depending on the material, the length, of the intermediate transfer belt, the number of rollers over which the intermediate transfer belt is stretched, the pitch of the photosensitive drums, and the accuracy of each component.

Therefore, it is difficult to apply correction to all the factors that cause the speed fluctuation of the belt. Generally, in majority of cases, it is the speed fluctuation of the belt due to the fluctuating frequency component of low frequency that deteriorates the image quality. The correction of up to about 100 Hz applied in these cases, is sufficient to serve the purpose.

Figure 16:
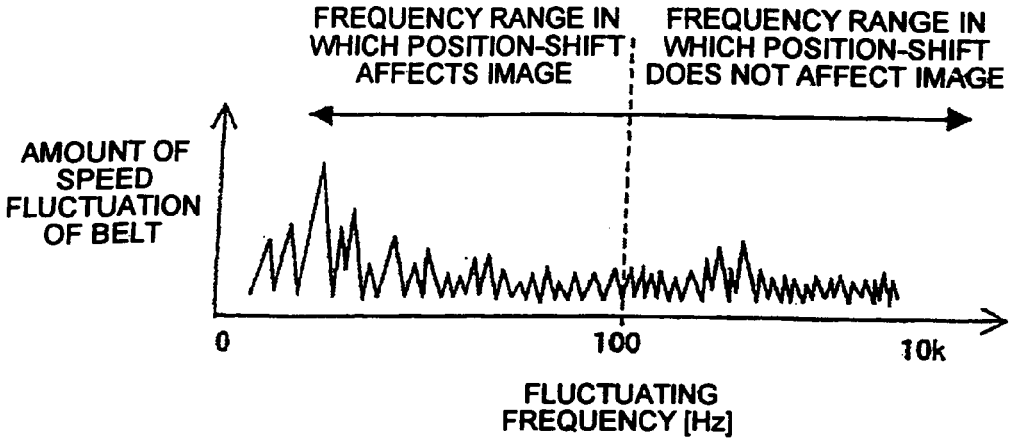
FIG. 16 is a graphical representation of a relationship between the fluctuating frequency and position shift of an image.

Thus, if a range of correction that is applied to the belt speed is restricted to the fluctuating frequency component of low frequency not greater than 100 Hz as shown in FIG. 16, it is possible to assemble the feed-back loop 80 shown in FIG. 8 at a low cost.

Figure 17:
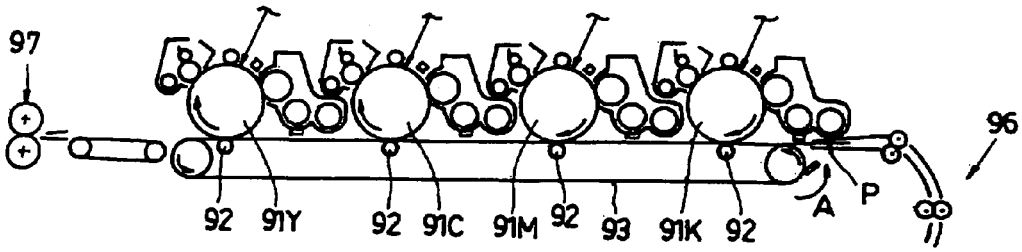
FIG.17 PRIOR ART
FIG. 17 is a schematic diagram of an image forming section in a conventional direct transfer image forming apparatus.
Figure 18:
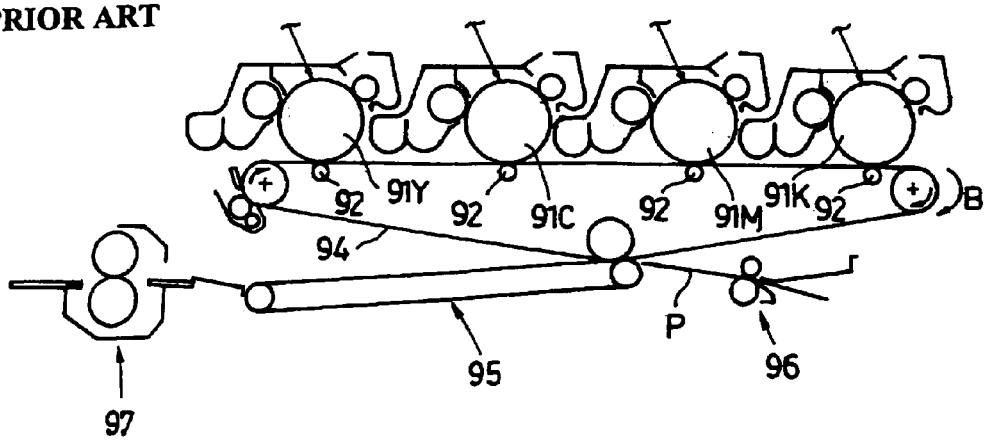
FIG.18 PRIOR ART
FIG. 18 is a schematic diagram of an image forming section in a conventional indirect-transfer image forming apparatus.

The embodiments in which the present invention is applied to the transferring unit and the image forming apparatus employing indirect transferring and the method of belt-speed correction for indirect transferring are described so far. The present invention can also be applied to the belt-speed correction in direct transferring that uses the sheet carrier belt. The sheet carrier belt is a recording-material carrier belt that carries the recording material such that the images on the plurality of photosensitive drums are transferred to the recording medium one after another so that the images are superimposed, as described by referring to FIG. 17.

Thus, according to the transferring unit, the image forming apparatus, and the method of belt-speed correction in the present invention, the belt speed is matched with the target speed by applying correction only to the fluctuating frequency component of low frequency that is developed due to the change in the speed of the belt slowly, apart from the small fluctuating frequency component of high frequency that is developed during the operation of the unit, from among the speed fluctuation of the belt. Therefore, the correction can be applied easily and at a low cost. Moreover, the correction enables to avoid the color shift and change in shades of colors in the image that is formed.

Second Embodiment

In the transferring unit and the image forming apparatus according to the first embodiment, the input section 71 in the controlling unit 70 inputs a speed component of the belt and extracts the fluctuating frequency component of low frequency from the speed component that is input. Further, the speed is controlled upon comparing the actual speed with the target speed. In a transferring unit and an image forming apparatus according to a second embodiment, the speed component of the belt is input and a judgment of whether the speed component of the belt that is input is a fluctuating component is made one after another. Further the speed is controlled upon comparing the actual speed with the target speed.

Figure 19:
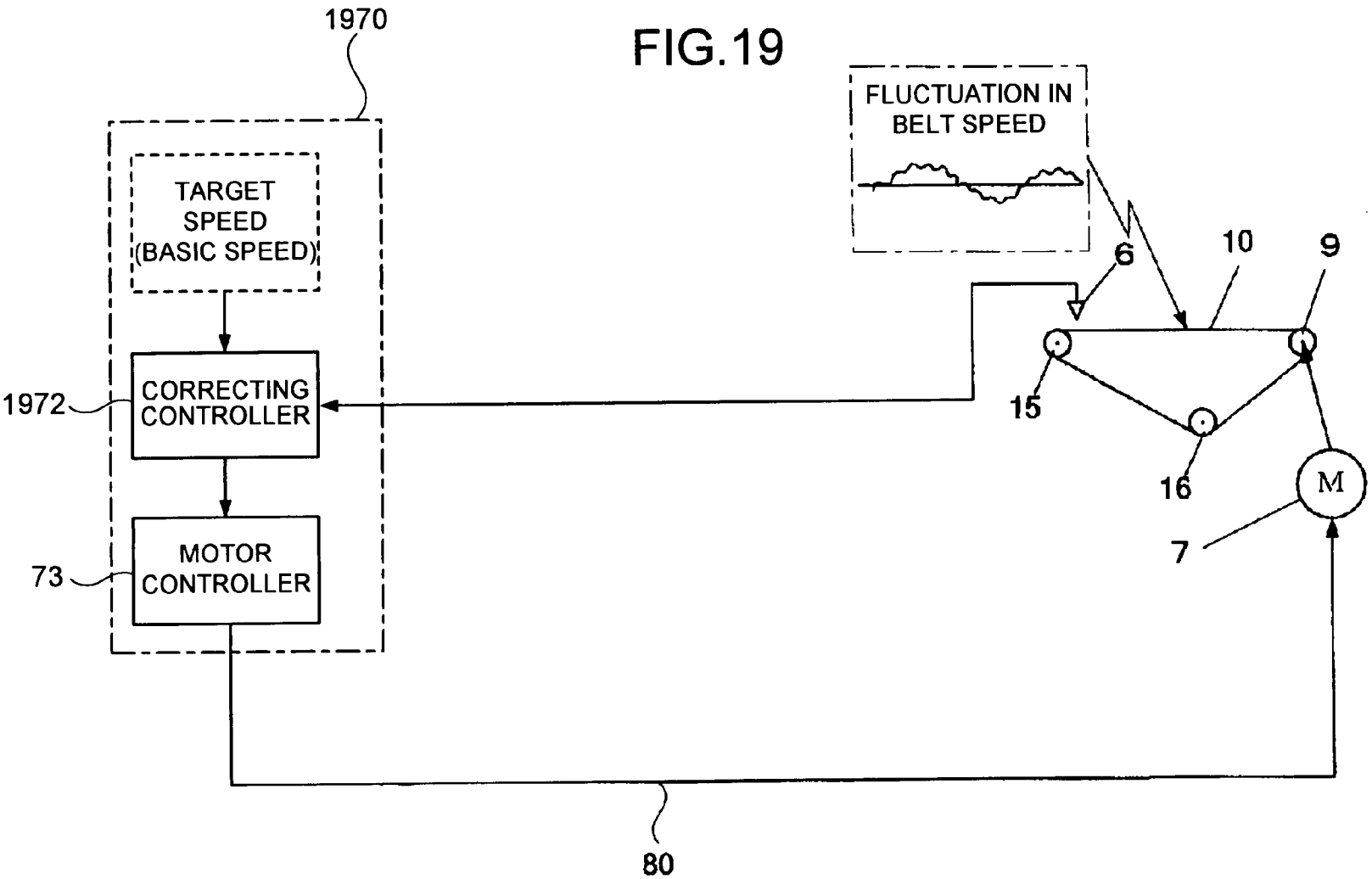
FIG. 19 is a schematic block diagram of a control system for controlling the belt speed of a transferring unit and an image forming apparatus according to a second embodiment.

FIG. 19 is a schematic block diagram of a control system for controlling the belt speed of the transferring unit and the image forming apparatus according to the second embodiment. A configuration of a controlling unit 1970 in the transferring unit and the image forming apparatus according to the second embodiment is different than that of the controlling unit 70 in the first embodiment.

The controlling unit 1970, similar to the controlling unit 70 in the first embodiment includes the CPU, the RAM, and the microcomputer. The CPU has functions of making various judgments and processing. The ROM stores process (computer) programs and fixed data and the RAM is a data memory that stores process data. The microcomputer includes an input and output (I/O) circuit.

The controlling unit 1970 also includes a correcting controller 1972 and a motor controller 73. The motor controller 73 functions similarly as the motor controller 73 in the controlling unit 70 according to the first embodiment.

The correcting controller 1972 inputs the speed fluctuation of the belt and makes a judgment of whether the speed fluctuation component that is input is the fluctuating frequency component of low frequency. The correcting controller 1972 compares the speed fluctuation component with the target speed (basic speed) of the intermediate transfer belt only when the fluctuating speed component is judged to be the fluctuating frequency component of low frequency. Further, the correcting controller 1972 sends a command to the motor controller 73 to adjust the speed to the target speed. The correcting controller 1972 and the motor controller 73 form the correction controlling unit according to the present invention. A phase locked loop (PLL) can be used as the correcting controller. Factors attributable to the speed fluctuation are the same as the factors in the first embodiment.

Figure 20:
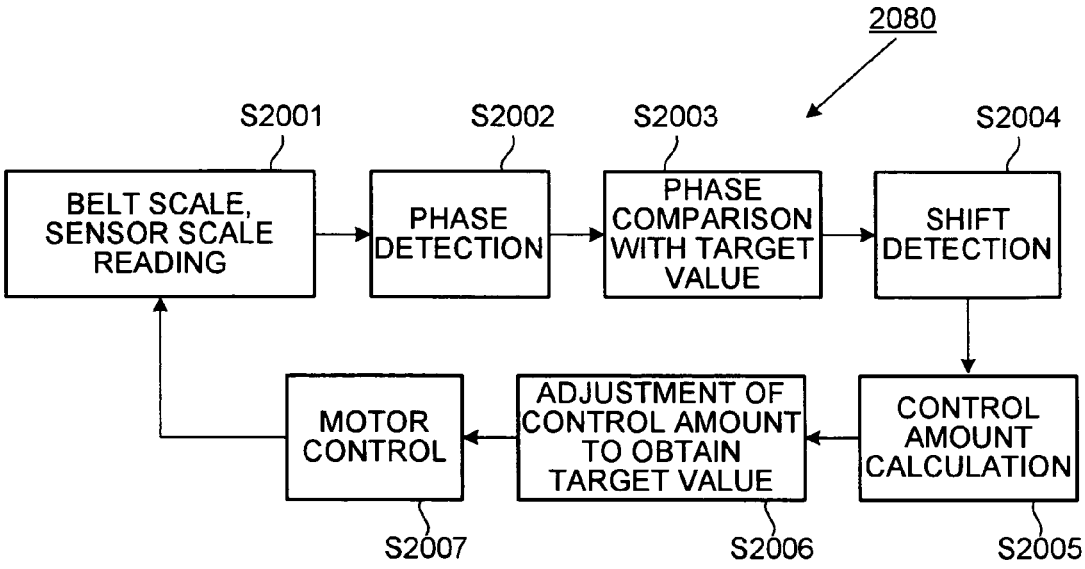
FIG. 20 is a block diagram of a feed-back loop of a control that is performed by the transferring unit according to the second embodiment.

FIG. 20 is a block diagram of a feed-back loop of a control that is performed by the transferring unit according to the second embodiment. The feed-back loop 80 reads the scale 5 that is provided along the overall circumference of the intermediate transfer belt 10 with the sensor 6 (step S2001) and detects the actual speed of the intermediate transfer belt 10 from the scale 5 that is detected by the sensor 6. The correcting controller 1972 detects a phase of the speed fluctuation (step 2002). Further, a judgment of whether the phase of the speed fluctuation is a fluctuating frequency component of low frequency is made and the phase of the speed fluctuation is compared with target speed only if the phase is judged to be the fluctuating frequency component of low frequency (step S2003) and an amount of shift is detected (step S2004). If the phase is not the fluctuating frequency component of low frequency, the phase is not compared with the target speed.

If the phase is a fluctuating frequency component of low frequency, the feed-back loop 80 calculates the amount of speed that is to be added to or subtracted from the actual speed (step 2005) and controls the belt drive motor 7 according to the actual speed of the intermediate transfer belt 10 (step S2006) and performs correction control of the intermediate transfer belt 10.

Thus, according to the transferring unit and the image forming apparatus according to the second embodiment, the color shift can be prevented by performing correction of the fluctuating frequency component of low frequency that is developed due to the change in the speed of the belt slowly, apart from the fluctuating frequency component of high frequency, from among the speed fluctuations of the intermediate transfer belt 10.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A transfer apparatus comprising:

a belt that rotates and carries either one of a plurality of images directly and a recording material with a plurality of images, a scale is provided along at least one side of entire of the belt;

a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt as a result of an unevenness in a thickness of the belt, from among speed fluctuations of the belt to adjust the speed of the belt to a predetermined target speed.

2. The transfer apparatus according to claim 1, wherein the frequency correcting unit includes an extracting unit that extracts only the frequency component that is fluctuating; and a correction control unit that performs correction of the frequency component that is fluctuating extracted by the extracting unit.

3. The transfer apparatus according to claim 2, wherein the frequency component that is fluctuating appears repeatedly on periodic basis due to any one of components of the belt and components of a driving system of the belt.

4. The transfer apparatus according to claim 2, wherein the frequency component that is fluctuating is not greater than 100 hertz.

5. The transfer apparatus according to claim 3, wherein the component of the driving system includes a roller that drives the belt and the fluctuation in the speed of the belt due to the frequency component that is fluctuating is caused by an eccentricity of the roller.

6. The transfer apparatus according to claim 5, wherein the fluctuation in the speed of the belt due to the frequency component that is fluctuating includes a change in an amount of the eccentricity of the roller with a change in a temperature of an environment.

7. The transfer apparatus according to claim 3, wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

8. The transfer apparatus according to claim 2, wherein the fluctuation in the speed of the belt due to the frequency component that is fluctuating is also caused by eccentricity of the roller that drives the belt.

9. The transfer apparatus according to claim 2, wherein the fluctuation in speed due to the frequency component that is fluctuating is due to eccentricity of the roller that drives the belt and fluctuation in thrust due to pressing the tension roller against the belt.

10. The transfer apparatus according to claim 2, wherein the belt is an intermediate transfer belt that transfers the images on the plurality of photosensitive drums by directly transferring the images one after another so that the images are superimposed.

11. The transfer apparatus according to claim 2, wherein the belt is a recording-material carrier belt that carries the recording material and the images on the plurality of photosensitive drums are transferred to the recording material one after another so that the images are superimposed.

12. The transfer apparatus according to claim 1, wherein the frequency-control unit inputs the speed fluctuations and while inputting the speed fluctuations, performs correction of only the frequency component that is fluctuating that is smaller than a predetermined frequency, to adjust the speed of the belt to the target speed.

13. The transfer apparatus according to claim 12, wherein the frequency component that is fluctuating appears repeatedly on periodic basis due to components of the belt or components of a belt-driving system.

14. The transfer apparatus according to claim 12, wherein the frequency component that is fluctuating of low frequency is not greater than 100 hertz.

15. The transfer apparatus according to claim 13, wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

16. The transfer apparatus according to claim 12, wherein the fluctuation in the speed of the belt due to the frequency component that is fluctuating is caused by eccentricity of the roller that drives the belt.

17. The transfer apparatus according to claim 12, wherein the fluctuation in speed due to the frequency component that is fluctuating is due to eccentricity of the roller that drives the belt and fluctuation in thrust due to pressing the tension roller against the belt.

18. The transfer apparatus according to claim 12, wherein the belt is an intermediate transfer belt that transfers the images on the plurality of photosensitive drums by directly transferring the images one after another so that the images are superimposed.

19. The transfer apparatus according to claim 12, wherein the belt is a recording-material carrier belt that carries the recording material and the images on the plurality of photosensitive drums are transferred to the recording material one after another so that the images are superimposed.

20. An image forming apparatus comprising:

a belt that rotates and carries either one of a plurality of images directly and a recording material with a plurality of images, a scale is provided along at least one side of entire of the belt; and a transfer apparatus that includes a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt as a result of an unevenness in a thickness of the belt, from among speed fluctuations of the belt to adjust the speed of the belt to a predetermined target speed.

21. The image forming apparatus according to claim 20, wherein the frequency correcting unit includes an extracting unit that extracts only the frequency component that is fluctuating; and a correction control unit that performs correction of the frequency component that is fluctuating extracted by the extracting unit.

22. The image forming apparatus according to claim 21, wherein the component of the driving system includes a roller that drives the belt and the fluctuation in the speed of the belt due to the frequency component that is fluctuating is caused by an eccentricity of the roller.

23. The image forming apparatus according to claim 21, wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

24. The image forming apparatus according to claim 21, wherein the belt is an intermediate transfer belt that transfers the images on the plurality of photosensitive drums one after another so that the images are superimposed and a transferring section is provided on a bottom side of the intermediate transfer belt to transfer the images on the intermediate transfer belt to the recording material.

25. The image forming apparatus according to claim 20, wherein the frequency-control unit inputs the speed fluctuations and while inputting the speed fluctuations, performs correction of only the frequency component that is fluctuating that is smaller than a predetermined frequency, to adjust the speed of the belt to the target speed.

26. The image forming apparatus according to claim 25, wherein the component of the driving system includes a roller that drives the belt and the fluctuation in the speed of the belt due to the frequency component that is fluctuating is caused by an eccentricity of the roller.

27. The image forming apparatus according to claim 25, wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

28. The image forming apparatus according to claim 25, wherein the belt is an intermediate transfer belt that transfers the images on the plurality of photosensitive drums one after another so that the images are superimposed and a transferring section is provided on a bottom side of the intermediate transfer belt to transfer the images on the intermediate transfer belt to the recording material.

29. A method of correcting a speed of a belt, comprising:

reading a scale on the belt to obtain scale information, the belt being rotatable and carries either one of a plurality of images directly and a recording material with a plurality of images, a scale is provided along at least one side of a portion of the belt;

calculating a speed of the belt from the scale information; and correcting fluctuating frequency component of low frequency smaller than a predetermined frequency that is developed during operation as a result of an unevenness in a thickness of the belt, from among the speed fluctuations of the belt to adjust the speed of the belt to a predetermined target speed.

30. The method according to claim 29, wherein the frequency component that is fluctuating appears repeatedly on periodic basis due to any one of components of the belt and components of a driving system of the belt.

31. The method according to claim 29, wherein the frequency component that is fluctuating is not greater than 100 hertz.

32. The method according to claim 30, wherein the component of the driving system includes a roller that drives the belt and the fluctuation in the speed of the belt due to the frequency component that is fluctuating is caused by an eccentricity of the roller.

33. The method according to claim 30, wherein the fluctuation in the speed of the belt due to the frequency component that is fluctuating is caused by a fluctuation in thrust due to pressing a tension roller against the belt.

34. The method according to claim 30, wherein the fluctuation in speed due to the frequency component that is fluctuating is due to eccentricity of a roller that drives the belt and fluctuation in thrust due to pressing a tension roller against the belt.

35. A transfer apparatus comprising:

a belt that rotates and carries either one of a plurality of images directly and a recording material with a plurality of images, a scale is provided along at least one side of entire of the belt;

a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed, wherein the frequency correcting unit includes an extracting unit that extracts only the frequency component that is fluctuating and a correction control unit that performs correction of the frequency component that is fluctuating extracted by the extracting unit, wherein the frequency component that is fluctuating appears repeatedly on periodic basis due to any one of components of the belt and components of a driving system of the belt, and wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

36. A transfer apparatus comprising:

a belt that rotates and carries either one of a plurality of images directly and a recording material with a plurality of images, a scale is provided along at least one side of entire of the belt;

a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed, wherein the frequency-control unit inputs the speed fluctuations and while inputting the speed fluctuations, performs correction of only the frequency component that is fluctuating that is smaller than a predetermined frequency, to adjust the speed of the belt to the target speed, wherein the frequency component that is fluctuating appears repeatedly on periodic basis due to components of the belt or components of a belt-driving system, and wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

37. An image forming apparatus comprising:

a belt that rotates and carries either one of a plurality of images directly and a recording material with a plurality of images, a scale is provided along at least one side of entire of the belt; and a transfer apparatus that includes a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed, wherein the frequency correcting unit includes an extracting unit that extracts only the frequency component that is fluctuating and a correction control unit that performs correction of the frequency component that is fluctuating extracted by the extracting unit, and wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

38. An image forming apparatus comprising:

a belt that rotates and carries either one of a plurality of images directly and a recording material with a plurality of images, a scale is provided along at least one side of entire of the belt; and a transfer apparatus that includes a sensor that reads the scale on the belt to obtain scale information;

an actual speed calculating unit that calculates a speed of the belt from the scale information; and a control unit that provides a control to correct speed of the belt according to the speed calculated, wherein the control unit includes a frequency-correcting unit that performs correction of only a frequency component that is fluctuating of low frequency that is smaller than a predetermined frequency that is developed due to a change in a speed of the belt, from among speed fluctuations of the belt to adjust the speed of the belt to a predetermined target speed, wherein the frequency-control unit inputs the speed fluctuations and while inputting the speed fluctuations, performs correction of only the frequency component that is fluctuating that is smaller than a predetermined frequency, to adjust the speed of the belt to the target speed, and wherein the component of the belt-driving system includes a tension roller that is in contact with the belt and stretches the belt with a predetermined tension, and the fluctuation in the speed of the belt due to the frequency component that is fluctuating is caused by a fluctuation in thrust due to pressing the tension roller against the belt.

39. A method of correcting a speed of a belt, comprising:

reading a scale on the belt to obtain scale information, the belt being rotatable and carries either one of a plurality of images directly and a recording material with a plurality of images, a scale is provided along at least one side of a portion of the belt;

calculating a speed of the belt from the scale information; and correcting fluctuating frequency component of low frequency smaller than a predetermined frequency that is developed during operation, from among the speed fluctuations of the belt to adjust the speed of the belt to a predetermined target speed, wherein the frequency component that is fluctuating appears repeatedly on periodic basis due to any one of components of the belt and components of a driving system of the belt, and wherein the fluctuation in the speed of the belt due to the frequency component that is fluctuating is caused by a fluctuation in thrust due to pressing a tension roller against the belt.

* * * * *